US009872539B2

(12) United States Patent
Beers

(10) Patent No.: US 9,872,539 B2
(45) Date of Patent: Jan. 23, 2018

(54) ARTICLE WITH TENSIONING SYSTEM INCLUDING DRIVEN TENSIONING MEMBERS

(71) Applicant: NIKE, Inc., Beaverton, OR (US)

(72) Inventor: Tiffany A. Beers, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 267 days.

(21) Appl. No.: 14/468,847

(22) Filed: Aug. 26, 2014

(65) Prior Publication Data

US 2015/0040429 A1 Feb. 12, 2015

Related U.S. Application Data

(63) Continuation-in-part of application No. 13/939,208, filed on Jul. 11, 2013, now Pat. No. 9,609,918.

(51) Int. Cl.

| | |
|---|---|
| ***A43C 11/00*** | (2006.01) |
| ***A43B 1/00*** | (2006.01) |
| ***A43B 3/00*** | (2006.01) |
| ***A43B 11/00*** | (2006.01) |
| ***A43B 23/02*** | (2006.01) |
| ***A43C 11/16*** | (2006.01) |

(52) U.S. Cl.

CPC ..... *A43C 11/008* (2013.01); *A43B 1/0018* (2013.01); *A43B 3/0005* (2013.01); *A43B 11/00* (2013.01); *A43B 23/027* (2013.01); *A43C 11/165* (2013.01)

(58) Field of Classification Search

CPC ..... A43C 11/165; A43C 11/008; A43C 1/06; A43C 1/003; A43C 7/00; A43C 11/1402; A43C 11/146; A43B 5/04; A43B 5/0447; A43B 5/0435; A43B 3/0005; Y10T 24/2187

USPC ..... 36/50.1, 102, 50.5, 117.7, 119.1, 97, 36/118.1; 24/68 SK; 242/396.1, 396.2

See application file for complete search history.

(56) References Cited

U.S. PATENT DOCUMENTS

| | | | |
|---|---|---|---|
| 4,000,566 | A | 1/1977 | Famolare, Jr. |
| 4,270,285 | A | 6/1981 | Antonious |
| 4,408,403 | A | 10/1983 | Martin |

(Continued)

FOREIGN PATENT DOCUMENTS

| | | | |
|---|---|---|---|
| GB | 2 256 574 | A | 12/1992 |
| WO | 93/25107 | A1 | 12/1993 |

(Continued)

OTHER PUBLICATIONS

International Search Report and Written Opinion dated Nov. 7, 2014 in PCT/US2014/044480.

(Continued)

*Primary Examiner* — Sally Haden
*Assistant Examiner* — Jillian K Pierorazio
(74) *Attorney, Agent, or Firm* — Banner & Witcoff, Ltd.

(57) ABSTRACT

An article of footwear includes an intermediate covering portion with an adjustable volume. The intermediate covering portion is closed around the instep of the foot. The article also includes a tensioning system that can be used to change the volume of the intermediate covering portion. The tensioning system includes two tension balancing members engaged with driven tensioning members, and a common driving tensioning member that engages both tension balancing members.

19 Claims, 35 Drawing Sheets

(56) References Cited

U.S. PATENT DOCUMENTS

| | | | | |
|---|---|---|---|---|
| 4,654,985 | A | 4/1987 | Chalmers | |
| 4,811,503 | A | 3/1989 | Iwama | |
| 4,969,278 | A | 11/1990 | Ottieri | |
| 4,972,610 | A | 11/1990 | Tong | |
| 5,117,567 | A | 6/1992 | Berger | |
| 5,205,055 | A | 4/1993 | Harrell | |
| 5,325,613 | A * | 7/1994 | Sussmann | A43C 11/00 24/712.2 |
| 5,337,493 | A | 8/1994 | Hill | |
| 5,425,185 | A | 6/1995 | Gansler | |
| 5,463,822 | A | 11/1995 | Miller | |
| 5,570,522 | A | 11/1996 | Olson et al. | |
| 5,791,068 | A | 8/1998 | Bernier et al. | |
| 5,839,210 | A | 11/1998 | Bernier et al. | |
| 5,934,599 | A | 8/1999 | Hammerslag | |
| 6,032,387 | A * | 3/2000 | Johnson | A43C 1/06 36/118.1 |
| 6,088,936 | A | 7/2000 | Bahl | |
| 6,286,233 | B1 | 9/2001 | Gaither | |
| 6,378,230 | B1 | 4/2002 | Rotem et al. | |
| 6,416,074 | B1 | 7/2002 | Maravetz et al. | |
| 6,427,361 | B1 | 8/2002 | Chou | |
| 6,467,194 | B1 | 10/2002 | Johnson | |
| 6,691,433 | B2 | 2/2004 | Liu | |
| 7,065,906 | B2 | 6/2006 | Jones et al. | |
| 7,096,559 | B2 | 8/2006 | Johnson | |
| 7,134,224 | B2 | 11/2006 | Elkington et al. | |
| 7,281,341 | B2 | 10/2007 | Reagan et al. | |
| 7,370,440 | B1 | 5/2008 | Cole, III | |
| 7,392,990 | B2 | 7/2008 | Bussiere | |
| 7,721,468 | B1 | 5/2010 | Johnson et al. | |
| 7,752,774 | B2 | 7/2010 | Ussher | |
| 8,061,061 | B1 | 11/2011 | Rivas | |
| 8,146,273 | B2 | 4/2012 | Sokolowski | |
| 8,387,282 | B2 | 3/2013 | Baker et al. | |
| 8,468,657 | B2 | 6/2013 | Soderberg et al. | |
| 8,844,167 | B2 * | 9/2014 | Greene | A43B 23/025 36/45 |
| 9,248,040 | B2 | 2/2016 | Soderberg et al. | |
| D751,281 | S * | 3/2016 | Nickel | D2/978 |
| 9,375,052 | B2 * | 6/2016 | Krueger | A43C 1/00 |
| 9,622,538 | B2 * | 4/2017 | Deitesfeld | A43B 5/0449 |
| 9,693,605 | B2 * | 7/2017 | Beers | A43C 11/008 |
| 2003/0204938 | A1 | 11/2003 | Hammerslag | |
| 2004/0103560 | A1 | 6/2004 | Hollars | |
| 2004/0181972 | A1 | 9/2004 | Csorba | |
| 2005/0076536 | A1 | 4/2005 | Hatfield et al. | |
| 2005/0160627 | A1 | 7/2005 | Dalgaard et al. | |
| 2005/0198866 | A1 | 9/2005 | Wiper et al. | |
| 2005/0198867 | A1 | 9/2005 | Labbe | |
| 2006/0021204 | A1 * | 2/2006 | Young | A43C 7/00 24/712.4 |
| 2006/0162190 | A1 | 7/2006 | Nishiwaki et al. | |
| 2006/0191164 | A1 | 8/2006 | Dinndorf et al. | |
| 2007/0033836 | A1 | 2/2007 | Rasmussen | |
| 2007/0039209 | A1 | 2/2007 | White et al. | |
| 2007/0186447 | A1 | 8/2007 | Ramos | |
| 2007/0209234 | A1 | 9/2007 | Chou | |
| 2007/0240334 | A1 * | 10/2007 | Johnson | A43C 7/04 36/50.1 |
| 2008/0066345 | A1 | 3/2008 | Hammerslag et al. | |
| 2008/0086911 | A1 * | 4/2008 | Labbe | A43B 11/00 36/50.1 |
| 2008/0216351 | A1 | 9/2008 | Carroll et al. | |
| 2009/0000153 | A1 | 1/2009 | Grimmeisen | |
| 2010/0139057 | A1 | 6/2010 | Soderberg et al. | |
| 2010/0251564 | A1 | 10/2010 | Meschter | |
| 2010/0319216 | A1 * | 12/2010 | Grenzke | A43C 1/00 36/54 |
| 2011/0258876 | A1 * | 10/2011 | Baker | A43C 11/008 36/50.1 |
| 2012/0005923 | A1 | 1/2012 | Beers et al. | |
| 2012/0117821 | A1 | 5/2012 | Adams et al. | |
| 2012/0240428 | A1 | 9/2012 | Knoll | |
| 2014/0070042 | A1 | 3/2014 | Beers et al. | |

FOREIGN PATENT DOCUMENTS

| | | | |
|---|---|---|---|
| WO | 2006/074067 | A1 | 7/2006 |
| WO | 2009/071652 | A1 | 6/2009 |

OTHER PUBLICATIONS

International Preliminary Report on Patentability and Written Opinion of the International Searching Authority dated Jan. 21, 2016 in International Patent Application No. PCT/US2014/044480.

International Search Report and Written Opinion dated Jul. 31, 2015 in PCT/US2015/029401.

* cited by examiner

ARTICLE WITH TENSIONING SYSTEM INCLUDING DRIVEN TENSIONING MEMBERS

CROSS-REFERENCE TO RELATED APPLICATIONS

This application is a continuation-in-part of U.S. Pat. No. 9,609,918, filed as U.S. patent application Ser. No. 13/939,208, on Jul. 11, 2013, under the title "Article with Closed Instep Portion Having Variable Volume", the entirety of which is herein incorporated by reference. This application is also related to U.S. patent application Ser. No. 14/468,795, filed Aug. 26, 2014, and titled "Article with Tensioning System Including Tension Balancing Member," the entirety of which is herein incorporated by reference.

BACKGROUND

The present embodiments relate generally to articles of footwear, and in particular to an article of footwear with tensioning members.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. In addition, the upper may include a tongue that extends under the lacing system to enhance adjustability and comfort of the footwear, and the upper may incorporate a heel counter.

SUMMARY

In one aspect, an article of footwear includes an upper having a toe covering portion and an entry hole for receiving a foot. The article includes an intermediate covering portion disposed between the toe covering portion and the entry hole, where the intermediate covering portion is closed around the instep of the foot and wherein the volume of the intermediate covering portion is variable. The article includes a tension balancing member with a first post portion, a second post portion and a third post portion. The article includes a driving tensioning member with a first portion attached to the first post portion of the tension balancing member and the driving tensioning member has a second portion attached to a tensioning device. The article includes a first driven tensioning member disposed around the second post portion, where the ends of the first driven tensioning member are attached to the upper. The article includes a second driven tensioning member disposed around the third post portion, where the ends of the second driven tensioning member are attached to the upper. The driven tensioning member is fixed in place with respect to the tension balancing member. The first driven tensioning member can translate around the second post portion of the tension balancing member and the second driven tensioning member can translate around the third post portion of the tension balancing member. Increasing the tension of the driving tensioning member results in increased tension in the first tensioning member and the second tensioning member, which substantially decreases the volume of the intermediate covering portion.

In another aspect, an article of footwear includes an upper having an instep portion. The article also includes a tension balancing member, where the tension balancing member has a central axis. The article further includes a driving tensioning member including a portion engaging the tension balancing member and the driving tensioning member including a portion associated with a tensioning device, the tensioning device being attached to the article of footwear. The article also includes a first driven tensioning member extending through the instep portion, where the first driven tensioning member has ends permanently attached to the article of footwear. The article also includes a second driven tensioning member extending through the instep portion, where the second driven tensioning member has ends permanently attached to the article of footwear. The tension balancing member can rotate about the central axis in response to forces applied to the tension balancing member by the driving tensioning member, the first driven tensioning member and the second driven tensioning member. Increasing tension in the driving tensioning member using the tensioning device increases the tension in the first driven tensioning member and the second driven tensioning member in order to fastening the upper.

In another aspect, an article of footwear includes an upper having an instep portion. The article also includes a tension balancing member including a first pulley device and a second pulley device. The article also includes a driving tensioning member with a first portion attached to the tension balancing member and a second portion attached to a tensioning device, where the tensioning device is attached to the article of footwear. The article also includes a first driven tensioning member disposed around the first pulley device. The ends of the first driven tensioning member are attached to the upper. The article also includes second driven tensioning member disposed around the second pulley device, where the ends of the second driven tensioning member are attached to the upper. The driving tensioning member is fixed in place with respect to the tension balancing member. The first driven tensioning member can move around the first pulley device and the second driven tensioning member can move around the second pulley device. Increasing tension in the driving tensioning member using the tensioning device increases the tension in the first driven tensioning member and the second driven tensioning member, thereby fastening the upper.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

FIGS. 1 through 4 illustrate schematic isometric views of an embodiment of an article of footwear 100, also referred to simply as article 100. Article 100 may be configured for use with various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 100 may be configured for use with various kinds of non-sports related footwear, including, but not limited to: slippers, sandals, high heeled footwear, loafers as well as any other kinds of footwear, apparel and/or sporting equipment (e.g., gloves, helmets, etc.).

Figure 1:
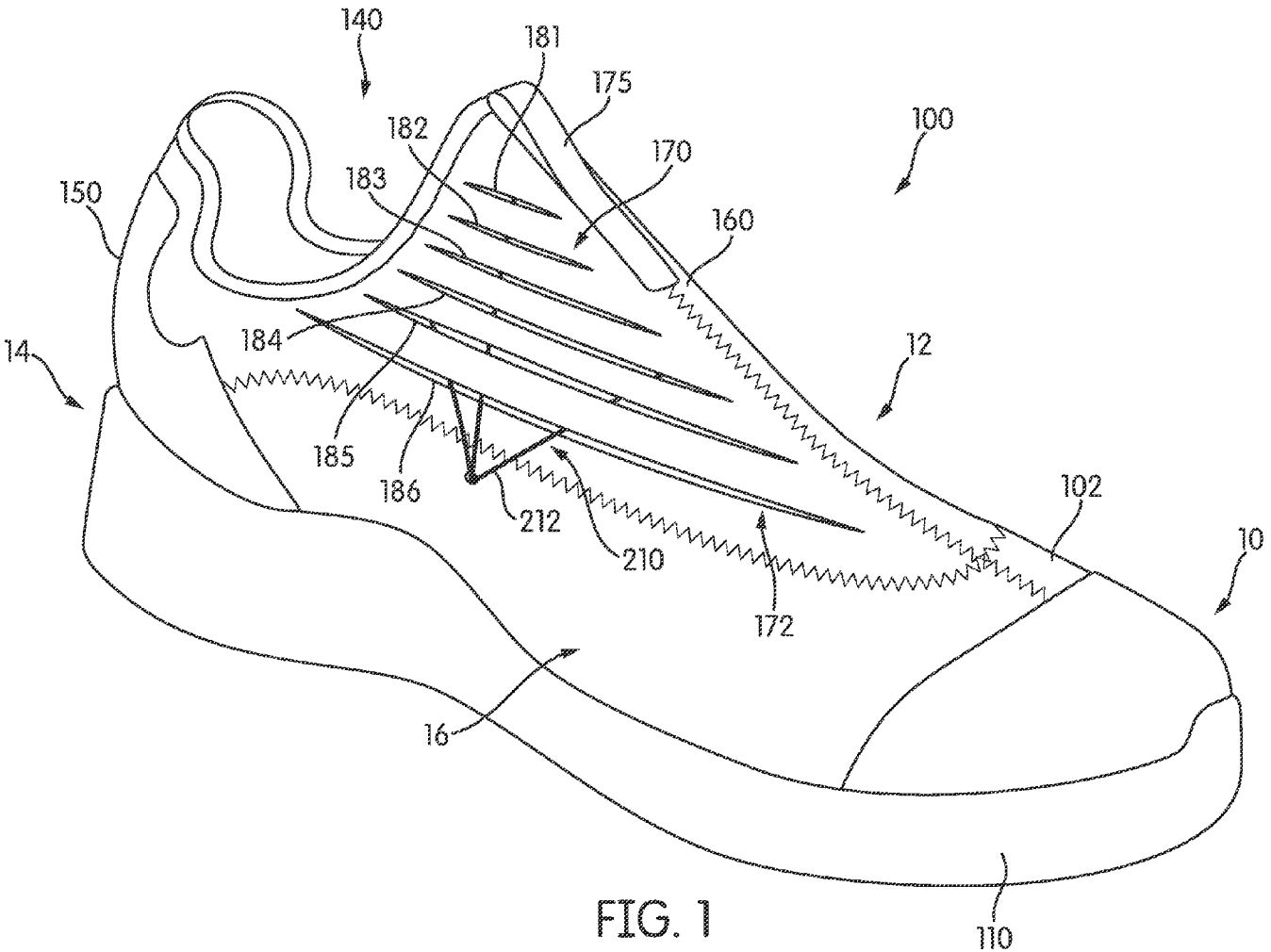
FIG. 1 is a lateral isometric view of an embodiment of an article of footwear.

Referring to FIG. 1, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18 (see FIG. 3). In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending along a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be used in describing individual components of an article, such as an upper and/or a sole structure.

Referring to FIGS. 1 through 4, article 100 may include an upper 102 as well as a sole structure 110. In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional. In an exemplary embodiment, sole structure 110 may include midsole 120 and outsole 122. As discussed in further detail below, some embodiments may include sole structures with internal cavities or recesses for receiving various components, for example a cavity for receiving an electronic device.

Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

Figure 3:
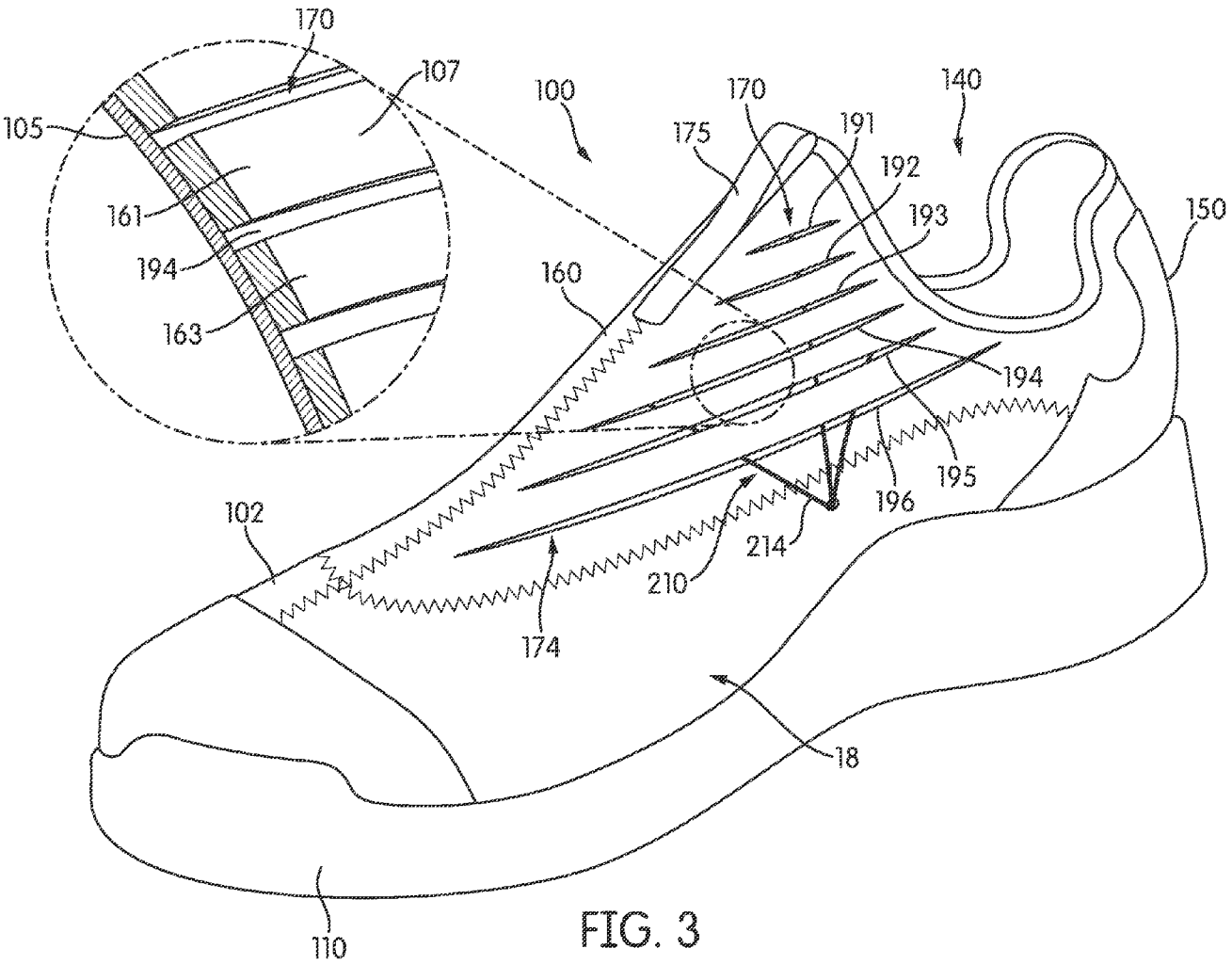
FIG. 3 is a medial isometric view of an embodiment of an article of footwear.

In different embodiments, the material construction of upper 102 could vary. In some embodiments, upper 102 may comprise a single base layer of material, such as, for example, a synthetic material layer. In other embodiments, however, upper 102 could comprise two or more material layers. As seen in FIG. 3, in some embodiments, upper 102 may be constructed with an inner layer 105 and an outer layer 107. In some embodiments, inner layer 105 could be substantially more elastic than outer layer 107. In other cases, however, inner layer 105 could be less elastic and/or have a similar elasticity to outer layer 107. In some embodiments, inner layer 105 could be a mesh layer, while outer layer 107 could be a foam layer. In some embodiments, the foam material of outer layer 107 may be less elastic than mesh material of inner layer 105.

In some embodiments, upper 102 includes opening 140 that provides entry for the foot into an interior cavity of upper 102. Opening 140 may be bounded from a rearward direction by heel portion 150 of upper 102. In some embodiments, upper 102 further includes an instep portion 160 that corresponds to the top of a foot.

In contrast to some other upper configurations, article 100 may generally be closed along the top of upper 102, including along instep portion 160. In other words, instep portion 160 may be configured as a closed portion. In particular, instep portion 160 may be closed around the instep of a foot, when a foot has been inserted into article 100.

For purposes of clarity, the term "intermediate covering portion" is used throughout this detailed description and in the claims to refer to a portion of an upper corresponding to an instep of the foot and surrounding parts of the foot. In some embodiments, the intermediate covering portion may include portions of the vamp, but not necessarily all of the vamp. Moreover, the intermediate covering portion described herein is most generally characterized as including the portions of the upper between a toe portion of the upper and an entry hole or opening of the upper.

Figure 5:
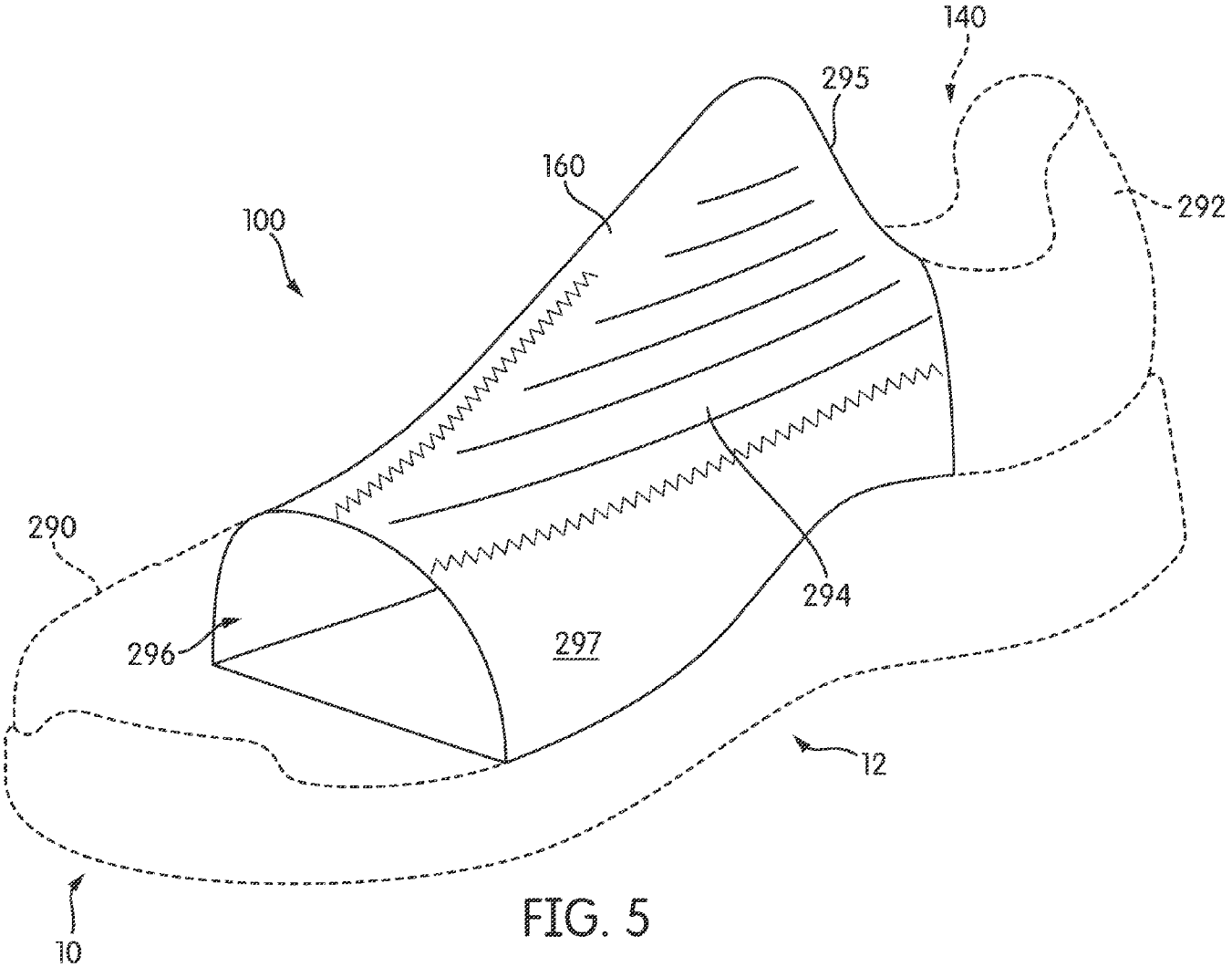
FIG. 5 is a schematic isometric view of an embodiment of an article of footwear, in which an intermediate covering portion is clearly depicted.

FIG. 5 illustrates a schematic view of an embodiment of article 100, in which an intermediate covering portion of article 100 has been highlighted. Referring to FIG. 5, article 100 may be characterized as having a toe covering portion 290, a rearward covering portion 292 and an intermediate covering portion 294 disposed between the toe covering portion 290 and the rearward covering portion 292. In FIG. 5, toe covering portion 290 and rearward covering portion 292 are indicated in phantom, while intermediate covering portion 294 is indicated with solid lines. In some embodiments, intermediate covering portion 294 may be bounded in a rearward direction by a forward edge 295 of opening 140. Moreover, intermediate covering portion 294 may include portions of forefoot portion 10 and/or midfoot portion 12. Further, intermediate covering portion 294 can include some or all of instep portion 160. Thus, in some embodiments, intermediate covering portion 294 generally covers the part of a foot forwards of the ankle and rearwards of the toes.

In some embodiments, intermediate covering portion 294 may generally define a volume 296, whose boundaries are associated with a surface 297 defined by intermediate covering portion 294. As portions of article 100 are expanded and contracted in response to changes in tension of various tensioning members, volume 296 may generally change accordingly. Thus, for example, as portions of article 100 contract with increased tension of tensioning system 200, volume 296 may decrease. Likewise, as portions of article 100 expand with decreased tension of tensioning system 200, volume 296 may increase.

In order to facilitate entry of a foot into upper 102, intermediate covering portion 294 may include provisions for expanding and contracting, especially at instep portion 160, which may be part of intermediate covering portion 294. In some embodiments, instep portion 160 may be configured with a plurality of channels 170 to facilitate expansion of instep portion 160, or more intermediate covering portion 294, as described in further detail below. In some embodiments, plurality of channels 170 further includes a first group of channels 172 and a second group of channels 174, associated with the lateral side 16 and medial side 18, respectively, of upper 102.

Referring to FIG. 1, in some embodiment, first group of channels 172 further comprises a first channel 181, a second channel 182, a third channel 183, a fourth channel 184, a fifth channel 185 and a sixth channel 186. Likewise, as seen in FIG. 3, second group of channels 174 further comprises a first channel 191, a second channel 192, a third channel 193, a fourth channel 194, a fifth channel 195 and a sixth channel 196. In some cases, the channels of first group of channels 172 and second group of channels 174 may be in one to one correspondence. For example, in some cases, first channel 181 of first group of channels 172 may correspond with first channel 191 of second group of channels 174. In particular, first channel 181 and first channel 191 may both have similar relative locations on lateral side 16 and medial side 18, respectively, of instep portion 160. Likewise, first channel 181 and first channel 191 could have substantially similar sizes and/or orientations on instep portion 160. In other embodiments, however, the channels of first group of channels 172 may not be in one to one correspondence with channels of second group of channels 174. For example, in other embodiments, instep portion 160 could include six channels on lateral side 16 and five channels on medial side 18.

In different embodiments, the depths of plurality of channels 170 relative to the material thickness of upper 102 can vary. In some embodiments, for example, plurality of channels 170 may be configured as channels extending through the entire thickness of upper 102. In other embodiments, however, plurality of channels 170 may not extend through the entire thickness of an upper material. In some embodiments, as seen in FIG. 3, plurality of channels 170 may extend through outer layer 107, but not through inner layer 105, of upper 102. Thus, plurality of channels 170 may generally separate adjacent segments of material in outer layer 107. For example, fourth channel 194 is seen to separate section 161 of outer layer 107 from section 163 of outer layer 107. With this arrangement, as upper 102 is stretched along instep portion 160, inner layer 105 may stretch accordingly, with adjacent sections of outer layer 107 further separating as plurality of channels 170 expand.

Figure 8:
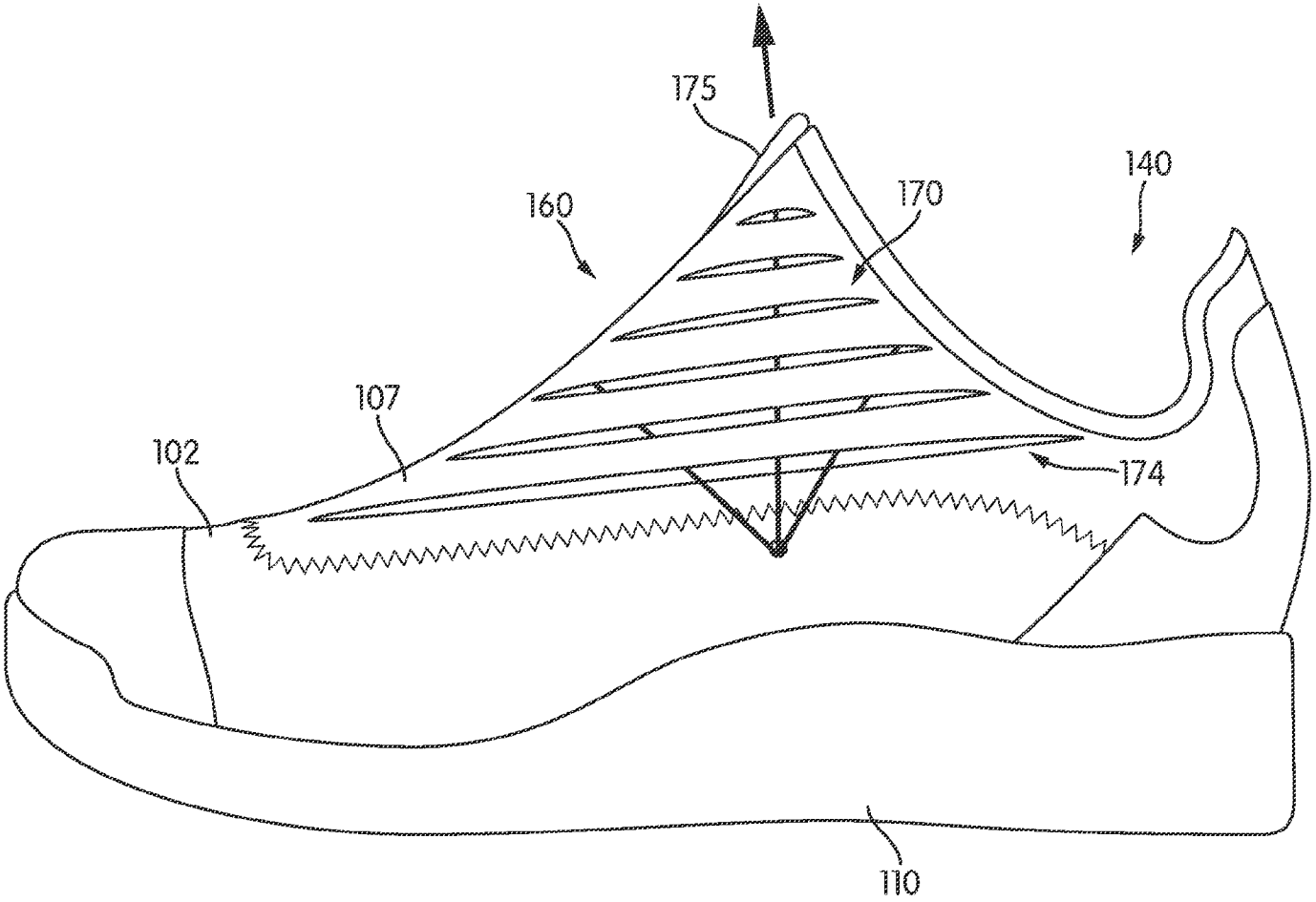
FIG. 8 is a side view of an embodiment of an article of footwear in which an instep portion undergoes expansion.

In different embodiments, the orientations of plurality of channels 170 could vary. In some embodiments, the channels comprising first group of channels 172 may be generally parallel to one another. In addition, in some cases, the channels comprising first group of channels 172 may be approximately oriented in the longitudinal direction. In a similar manner, in some embodiments, the channels comprising second group of channels 174 may be generally parallel and oriented approximately in the longitudinal direction. This general configuration for plurality of channels 170 on instep portion 160 may facilitate the expansion of instep portion 160, and of intermediate covering portion 294 more generally, in a direction that is generally perpendicular with the lengthwise orientations of plurality of channels 170. More specifically, as plurality of channels 170 expand along a widthwise direction of the channels that is generally perpendicular to the longitudinal direction of upper 102, instep portion 160 may expand in a direction approximately parallel to that widthwise direction. Such an expanded configuration is shown in FIG. 8 and described in further detail below. Moreover, as discussed further below, the expansion of plurality of channels 170 may result in a net increase in volume for portions of article 100, including for instance, an increase in the volume of instep portion 160 and of intermediate covering portion 294.

Some embodiments may include tab portion 175. In some embodiments, tab portion 175 is a tab-like portion disposed along the top of instep portion 160. In some embodiments, tab portion 175 has a looped geometry that can be easily grasped with a finger. In some cases, tab portion 175 may be disposed adjacent to opening 140. Tab portion 175 may be grasped and pulled by a user to expand instep portion 160. This allows opening 140 to increase in size temporarily, thereby permitting entry of a foot through opening 140. With tab portion 175 released, instep portion 160 may return to a pre-tensioned size and/or volume.

Embodiments can include provisions to facilitate contracting instep portion 160 (and thereby reducing its volume) once a foot has been inserted in order to tighten the fit of upper 102 to the foot. In some embodiments, article 100 may include tensioning system 200 (indicated in FIGS. 2 and 4) that may provide tension across instep portion 160. Tensioning system 200 may further comprise one or more tensioning members as well as a tensioning device. Examples of possible tensioning members that could be used include, but are not limited to: cables, wires, strings, laces, straps as well as any other kinds of tensioning members. Moreover, exemplary tensioning devices include, but are not limited to: winding devices (e.g., reels and spools), springs, as well as any other devices, systems or components that can be used to apply tension to any portion of a tensioning member.

In some embodiments, tensioning system 200 may include plurality of tensioning members 210. Plurality of tensioning members 210 may comprise cable-like or wire-like members. In particular, the tensioning members of the current embodiment may be characterized as being approximately one-dimensional. In other words, each tensioning member may generally have a length that is substantially greater than the width, thickness and/or diameter of the tensioning member. In other embodiments, however, one or more tensioning members could be approximately two-dimensional members (e.g., ribbons or straps).

Figure 2:
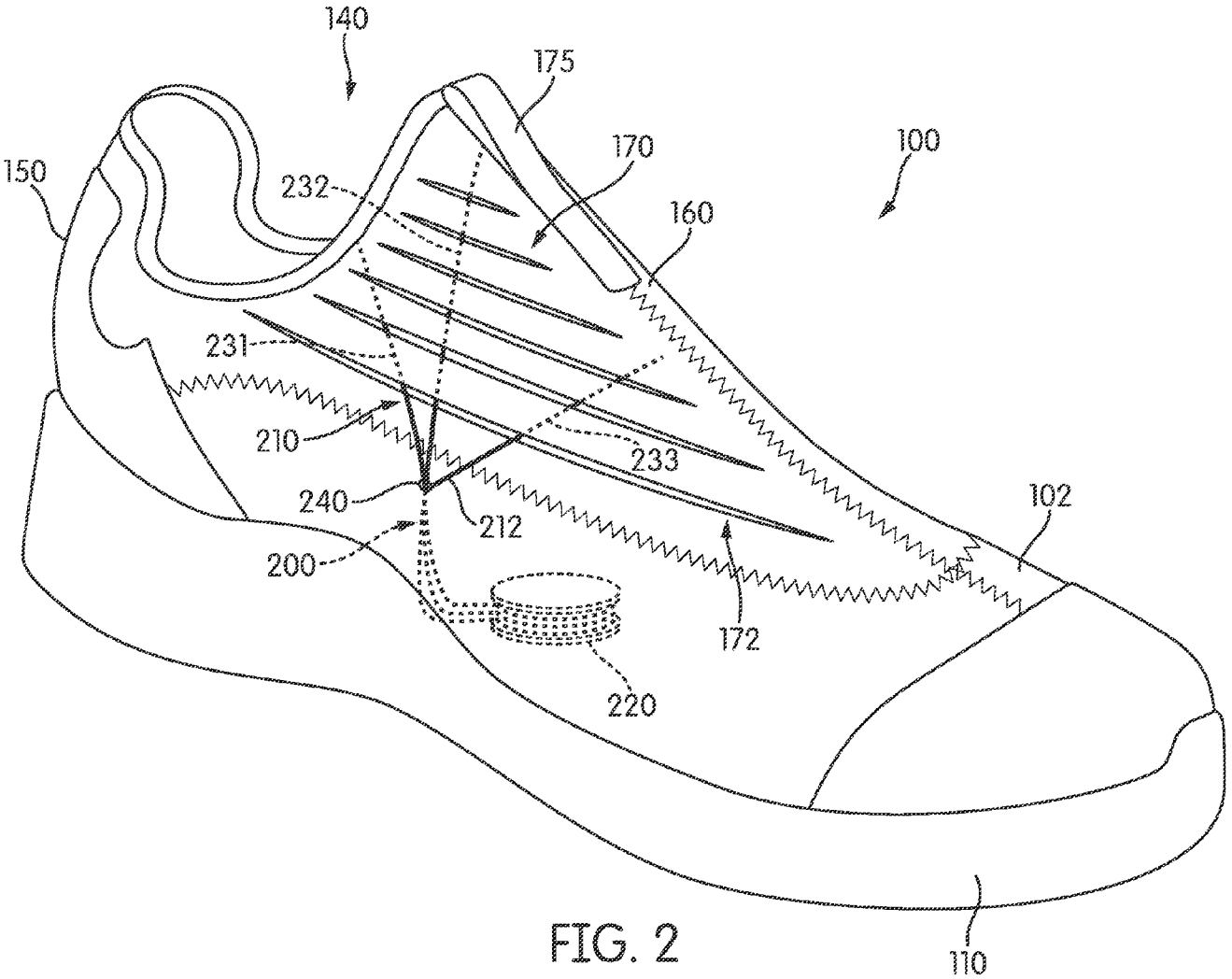
FIG. 2 is a lateral isometric view of an embodiment of an article of footwear including portions of a tensioning system shown in phantom.
Figure 4:
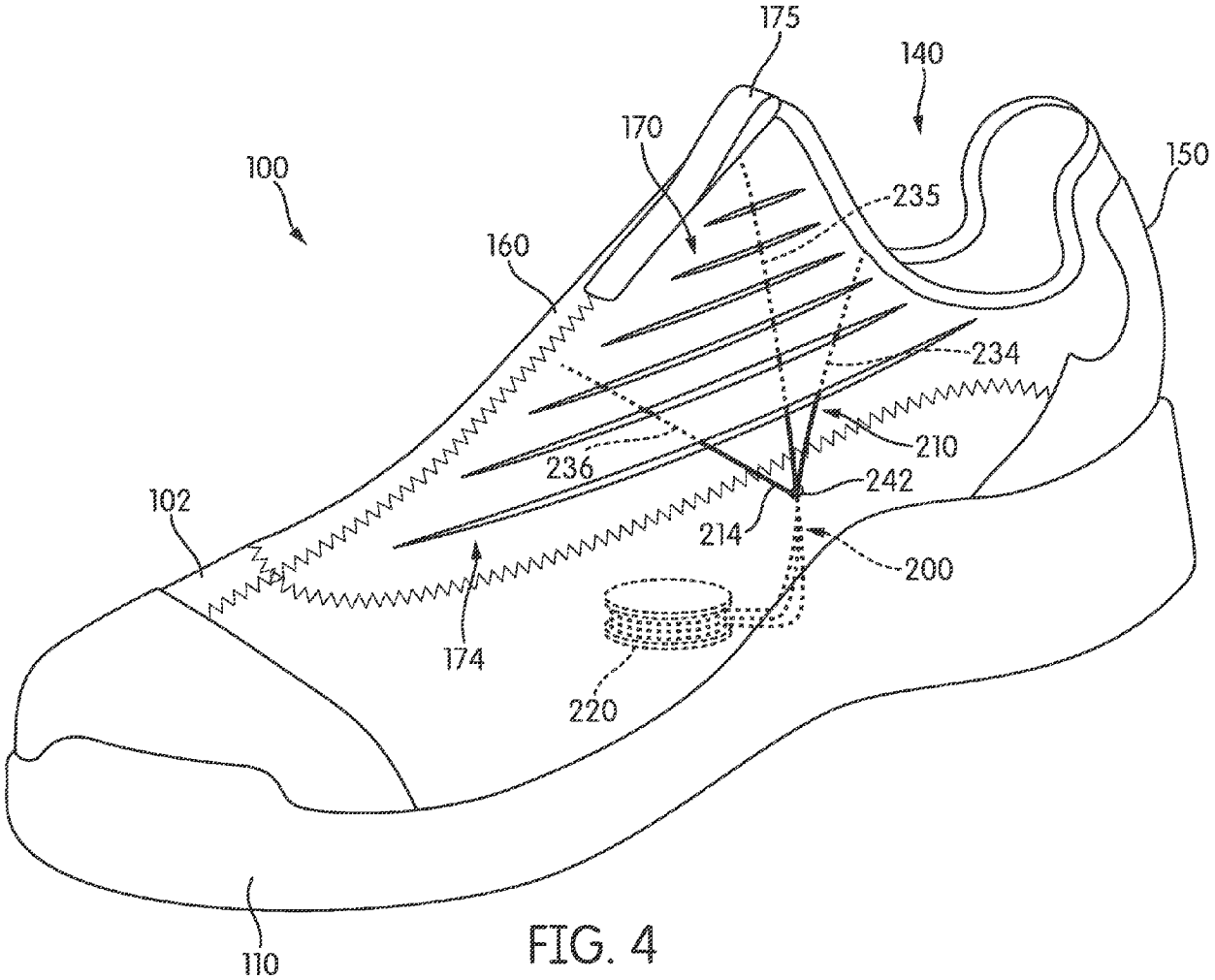
FIG. 4 is a medial isometric view of an embodiment of an article of footwear including portions of a tensioning system shown in phantom.

Plurality of tensioning members 210 may be further grouped into a first group of tensioning members 212 and a second group of tensioning members 214, which are associated with lateral side 16 and medial side 18, respectively, of upper 102. Generally, each group could have any number of tensioning members. In some embodiments, first group of tensioning members 212 and second group of tensioning members 214 may each comprise three distinct tensioning members. However, other embodiments could include any other number of tensioning members in each group of tensioning members, including one, two, three, four or more than four tensioning members. In particular, as seen in FIG. 2, first group of tensioning members 212 may include first tensioning member 231, second tensioning member 232 and third tensioning member 233. Likewise, as seen in FIG. 4, second group of tensioning members 214 may include fourth tensioning member 234, fifth tensioning member 235 and sixth tensioning member 236.

Tensioning system 200 further includes tensioning device 220 that may be used to adjust the tension in plurality of tensioning members 210. For purposes of clarity, tensioning device 220 is shown schematically in the current embodiments. However, tensioning device 220 may generally include provisions for receiving and winding tensioning members. Examples of different tensioning devices include, but are not limited to: reel devices with a ratcheting mechanism, reel devices with a cam mechanism, manual tensioning devices, automatic tensioning devices, as well as possibly other kinds of tensioning devices. Examples of a tensioning device comprising a reel and ratcheting mechanism that could be used with the current embodiments are disclosed in Soderberg et al., U.S. Patent Application Publication Number 2010/0139057, now U.S. patent application Ser. No. 12/623,362, filed Nov. 20, 2009 and titled "Reel Based Lacing System", the entirety of which is hereby incorporated by reference. Examples of a motorized tensioning device that could be used with the current embodiments are disclosed in Beers, U.S. Patent Publication Number 2014/0070042, published Mar. 13, 2014, and filed as U.S. patent application Ser. No. 14/014,555, on Aug. 30, 2013, and titled "Motorized Tensioning System with Sensors", the entirety being incorporated by reference herein. In an exemplary embodiment, tensioning device 220 could be a reel-based tensioning device that winds the tensioning members onto a reel to increase the tension.

In different embodiments, the location of tensioning device 220 could vary. In some embodiments, tensioning device 220 could be disposed in a portion of upper 102. In some embodiments, as shown in FIGS. 2 and 4, tensioning device 220 could be disposed in a portion of sole structure 110. In particular, in some cases, tensioning device 220 could be embedded within an internal cavity of sole structure 110. For purposes of clarity, the location of tensioning device 220 is shown schematically in the figures, but it will be appreciated that any method known in the art for incorporating various rigid components and devices into a sole and/or upper can be used.

Referring now to FIG. 2, the tensioning members of tensioning system 200 may generally extend from tensioning device 220 in sole structure 110 to portions of upper 102. For example, first tensioning member 231, second tensioning member 232 and third tensioning member 233 may extend from tensioning device 220, travel through and exit sole structure 110 and enter upper 102. In some embodiments, portions of each tension member may travel internally to upper 102, either along an inner side surface of upper 102, or between adjacent layers of upper 102 (such as between outer layer 107 and inner layer 105). First tensioning member 231, second tensioning member 232 and third tensioning member 233 may generally exit upper 102 at aperture 240. From aperture 240, first tensioning member 231, second tensioning member 232 and third tensioning member 233 may travel through instep portion 160. As discussed in further detail below, in some embodiments, first tensioning member 231, second tensioning member 232 and third tensioning member 233 may extend generally adjacent to one another from tensioning device 220 to aperture 240, but may separate and extend in various different directions upon exiting aperture 240. This arrangement allows lateral side 16 of instep portion 160 to be contracted by applying tension to first group of tensioning members 212 using tensioning device 220.

Referring now to FIG. 4, in some embodiments, fourth tensioning member 234, fifth tensioning member 235 and sixth tensioning member 236 may be configured in a similar manner to first tensioning member 231, second tensioning member 232 and third tensioning member 233. That is, fourth tensioning member 234, fifth tensioning member 235 and sixth tensioning member 236 may extend from tensioning device 220, travel through and exit sole structure 110 and enter upper 102. Each tensioning member may extend through a portion of upper 102 and exit upper 102 at aperture 242 on medial side 18. From upper opening 242, fourth tensioning member 234, fifth tensioning member 235 and sixth tensioning member 236 may extend through instep portion 160. This arrangement allows medial side 18 of instep portion 160 to be contracted by applying tension to second group of tensioning members 214 using tensioning device 220.

Figure 6:
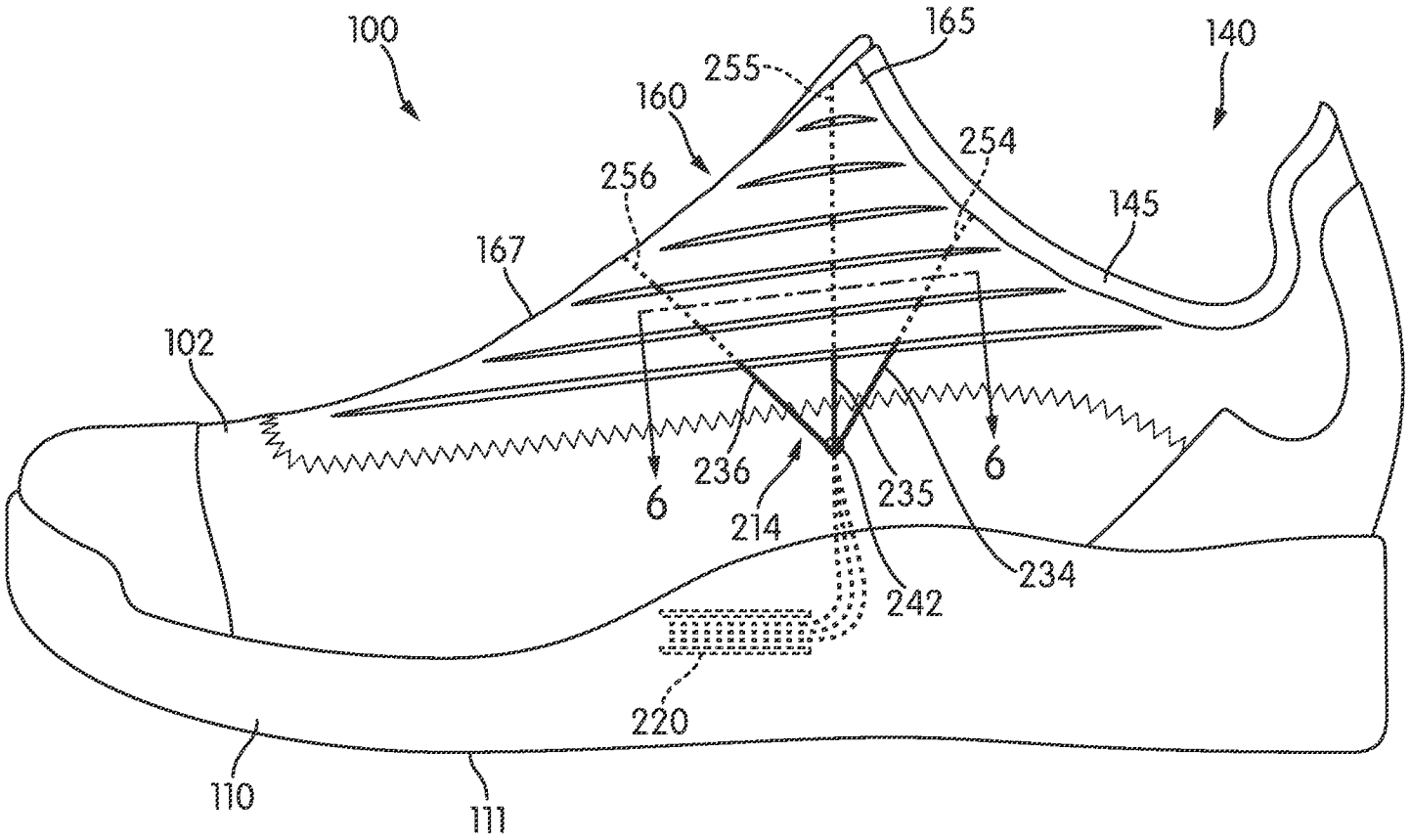
FIG. 6 is a side view of an embodiment of an article of footwear including a tensioning system for adjusting the volume of an instep portion.

FIG. 6 illustrates a medial side view of article 100. Referring to FIG. 6, the configuration of second group of tensioning members 214 along instep portion 160 can be clearly seen. In particular, after exiting upper opening 242, fourth tensioning member 234, fifth tensioning member 235 and sixth tensioning member 236 each extend towards the top of instep portion 160. Moreover, the tensioning members generally spread out in a radial direction from aperture 242. In some embodiments, fourth tensioning member 234 extends from aperture 242 to a periphery 145 of opening 140. Periphery 145 may be seen to bound instep portion 160 from the rearward direction. In some cases, an end portion 254 of fourth tensioning member 234 may be secured, or otherwise anchored, to a point along periphery 145. Likewise, fifth tensioning member 235 extends from aperture 242 to a top portion 165 of instep portion 160 that is generally vertically furthest from a lower surface 111 of sole structure 110. In some cases, an end portion 255 of fifth tensioning member 235 may be secured, or otherwise anchored, to top portion 165 of instep portion 160. In addition, sixth tensioning member 236 extends from aperture 242 to an upper forward portion 167 of instep portion 160. In some cases, an end portion 256 of sixth tensioning member may be secured, or otherwise anchored, to upper forward portion 167 of instep portion 160.

It will be understood that tensioning members of first group of tensioning members 212 may be configured in a similar manner on lateral side 16 of article 100. In particular, first tensioning member 231, second tensioning member 232 and third tensioning member 233 may extend outwardly from aperture 240 in a similar manner to fourth tensioning member 234, fifth tensioning member 235 and sixth tensioning member 236. In some embodiments, this arrangement may provide substantially symmetric tension along the lateral and medial sides of instep portion 160, thereby allowing tension to be applied in a generally symmetric manner. In other embodiments, however, first group of tensioning members 212 and second group of tensioning members 214 need not be arranged in a symmetric manner.

Figure 7:
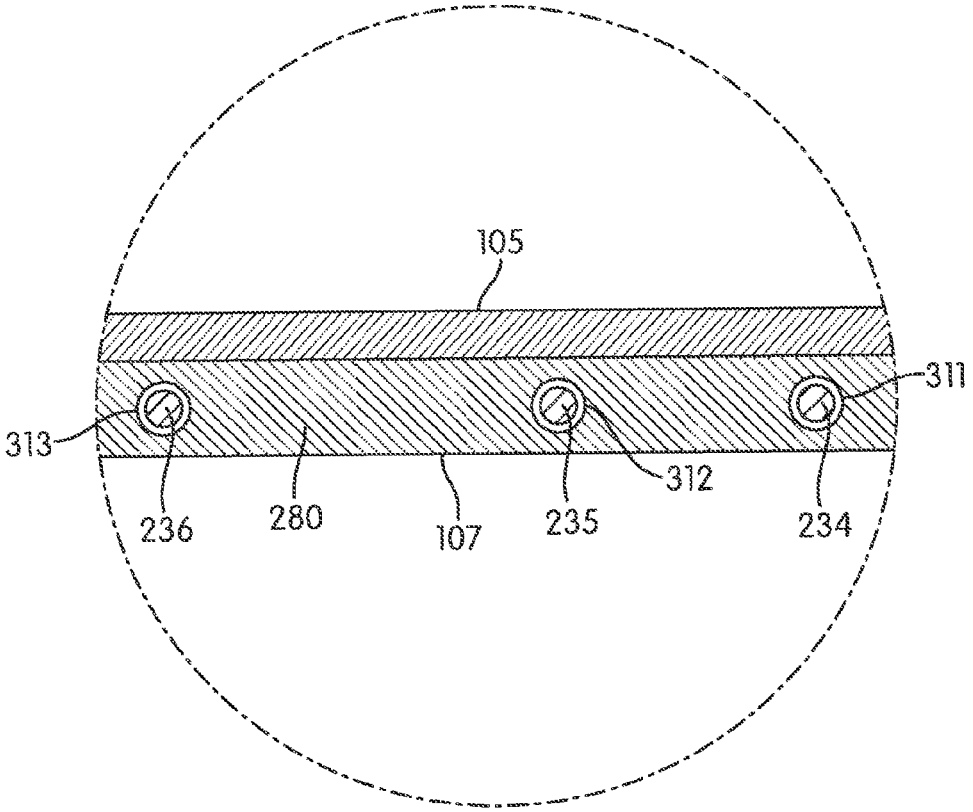
FIG. 7 is an enlarged cross-sectional view of an embodiment of an inner layer and an outer layer of an upper.

FIG. 7 is a cross-sectional view of a portion of upper 102, in which the layered structure of upper 102 is clearly seen. As seen in FIG. 7, in some embodiments one or more tensioning members may extend through cavities within outer layer 107. For example, in the current embodiment fourth tensioning member 234, fifth tensioning member 235 and sixth tensioning member 236 may extend through a first cavity 311, a second cavity 312 and third cavity 313, respectively. First cavity 311, second cavity 312 and third cavity 313 may be formed in a segment 280 of outer layer 107, which may be a segment disposed between adjacent channels of instep portion 160. In some embodiments, other portions of outer layer 107 may also include cavities to receive portions of each tensioning member. Using this arrangement, each tensioning member of second group of tensioning members 214 may be guided through instep portion 160 in a desired configuration.

With respect to tensioning members and the layers of upper 102, it will be understood that other arrangements are possible. In some other embodiments, one or more tensioning members could extend between outer layer 107 and inner layer 105. In still other embodiments, one or more tensioning members could extend externally to outer layer 107. In still other embodiments, one or more tensioning members could extend along an inner side of inner layer 105 (i.e., directly adjacent to a foot). In such an embodiment, tubes or other guides may be used to facilitate cushioning between the tensioning members and the foot.

Some embodiments could incorporate one or more internal and/or external guides that facilitate the alignment and travel of tensioning members. In some embodiments, one or more guides could be disposed within cavities of outer layer 107. In other embodiments, guides could be used to house portions of tensioning members that extend between cavities in adjacent sections of material. The use of guides, such as tubes, may further facilitate alignment of tensioning members and allow for smoother travel of the tensioning members. Such provisions, as well as the presence of inner layer 105, could also reduce the tendency of the tensioning members to apply unwanted pressures directly to the foot.

FIG. 8 illustrates a side view of article 100, in which instep portion 160 is undergoing expansion. As seen in FIG. 8, tension may be applied to tab portion 175 to expand instep portion 160. In particular, as tension is applied to instep portion 160, plurality of channels 170 (including second group of channels 174) expand as adjacent segments of outer layer 107 are separated from one another. As previously discussed, plurality of channels 170 may generally expand in along their width, which is generally perpendicular to the longitudinal direction of article 100. This expansion in the volume of instep portion 160 may increase the size of opening 140. This temporary increase in the size of opening 140 allows a user to easily insert their foot into upper 102.

Figure 9:
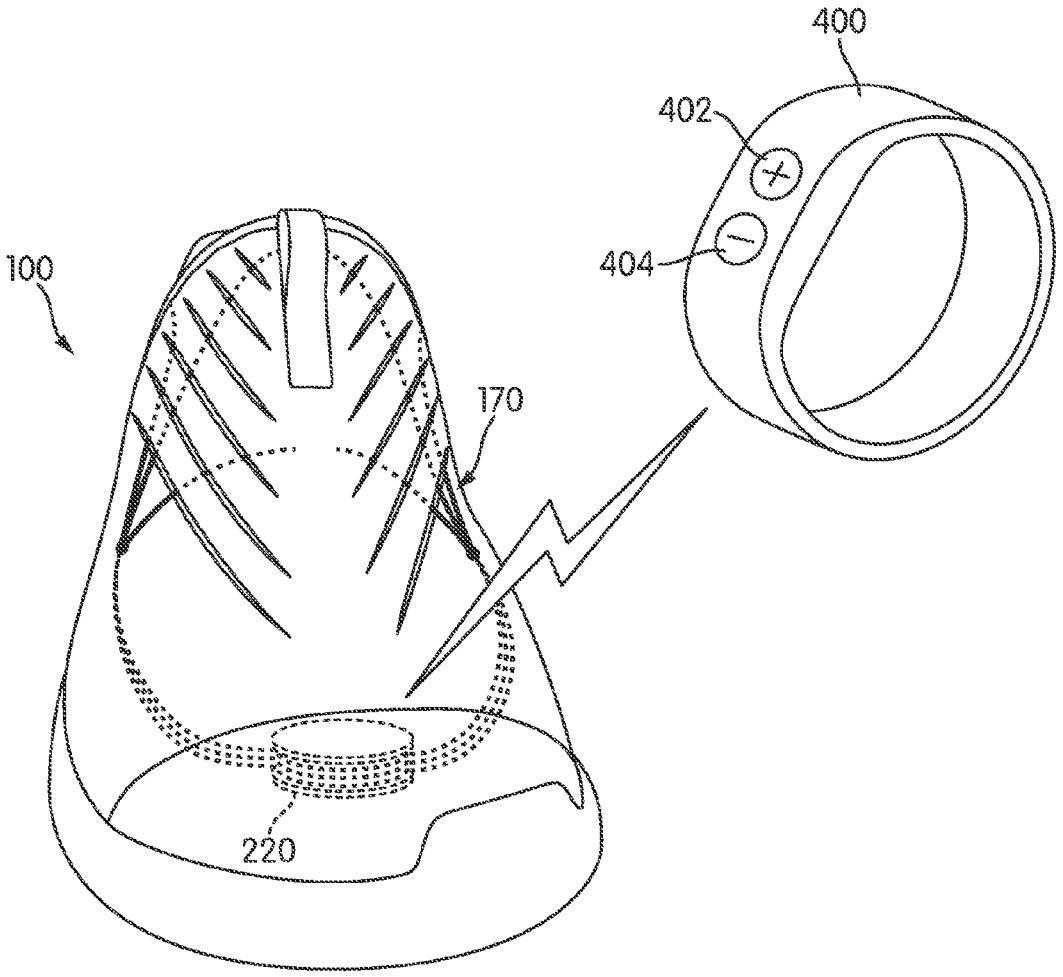
FIG. 9 is a schematic view of an embodiment of an article including a tensioning system and a remote device configured to operate the tensioning system.

FIG. 9 illustrates a schematic view of article 100 and a remote device 400. Remote device 400 may be in communication with tensioning device 220. In some embodiments, remote device 400 can include provisions that allow a user to remotely adjust the tension applied by tensioning device 220. In one embodiment, remote device 400 may include a tightening button 402 (indicated in FIG. 9 as a "plus" symbol) and a loosening button 404 (indicated in FIG. 9 as a "minus" symbol). This allows a user to adjust the tension by pressing tightening button 402 and/or loosening button 404. It will be understood that the tension could be adjusted in discrete steps (i.e., an incremental adjustment in tension each time a button is pressed) or could occur continuously (i.e., the tension is continuously adjusted as long as a button remains depressed).

In the current embodiment, remote device 400 is shown as a bracelet that may be worn by a user. In other embodiments, however, remote device 400 could be any other kind of device. Examples of other remote devices that could be used to communicate with tensioning device 220 include, but are not limited to: cell phones, smart phones, tablets, various kinds of remote control devices as well as any other kinds of remote devices. Moreover, a remote device can communicate with tensioning device 220 using any communication method including, but not limited to: radio signals, infra-red signals, as well as any other kinds of communication signals known in the art.

It will be understood that while the embodiments of the figures illustrate a tensioning system that uses a single tensioning device, other embodiments could incorporate two or more tensioning devices. In still another embodiment, for example, an article could include a separate tensioning device on each of the lateral and medial sides of the article. This alternative configuration could facilitate independent tensioning of tensioning members associated with the lateral and medial sides.

Figure 10:
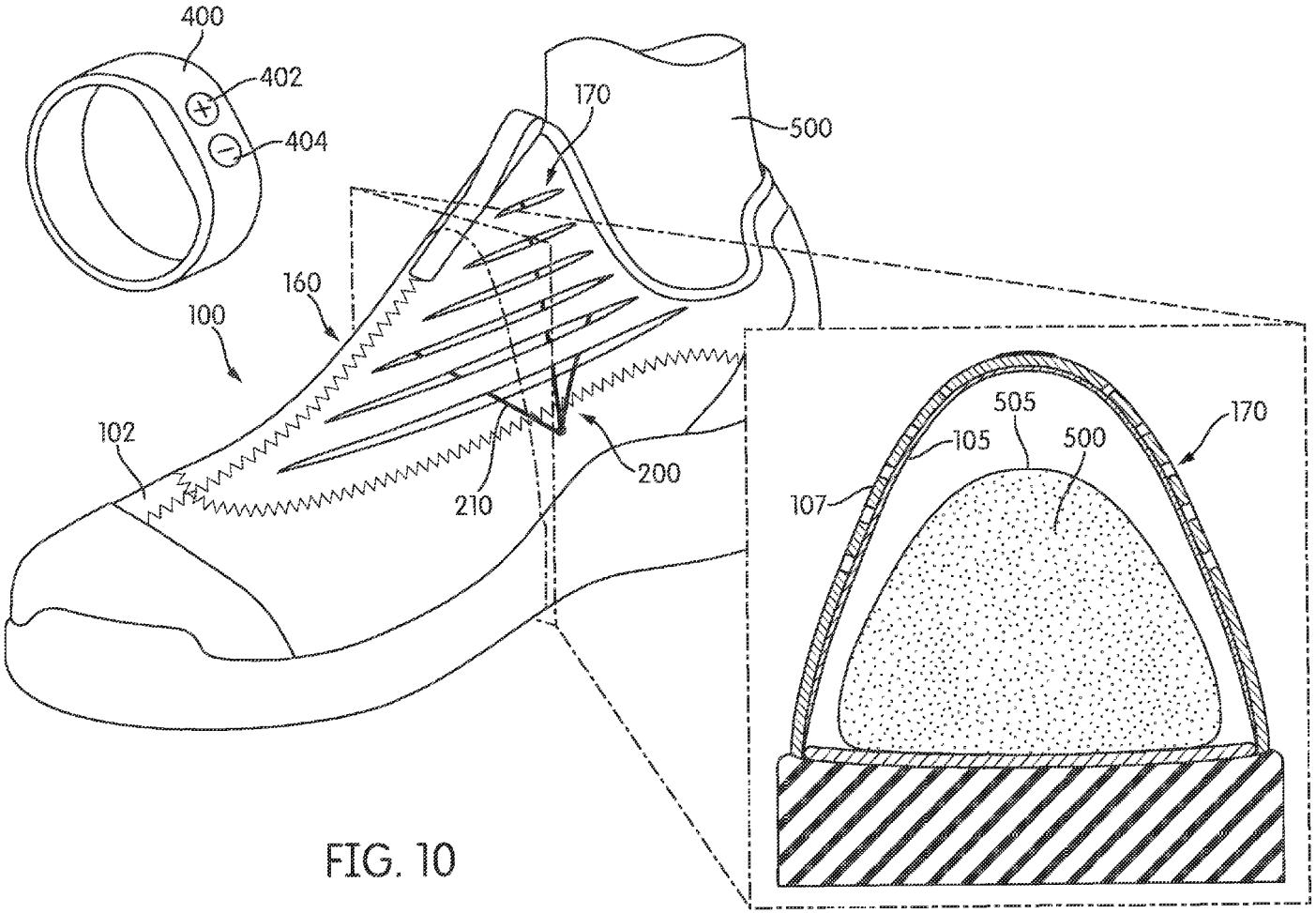
FIG. 10 is a schematic view of an embodiment of an article of footwear with a foot inserted into an upper.
Figure 11:
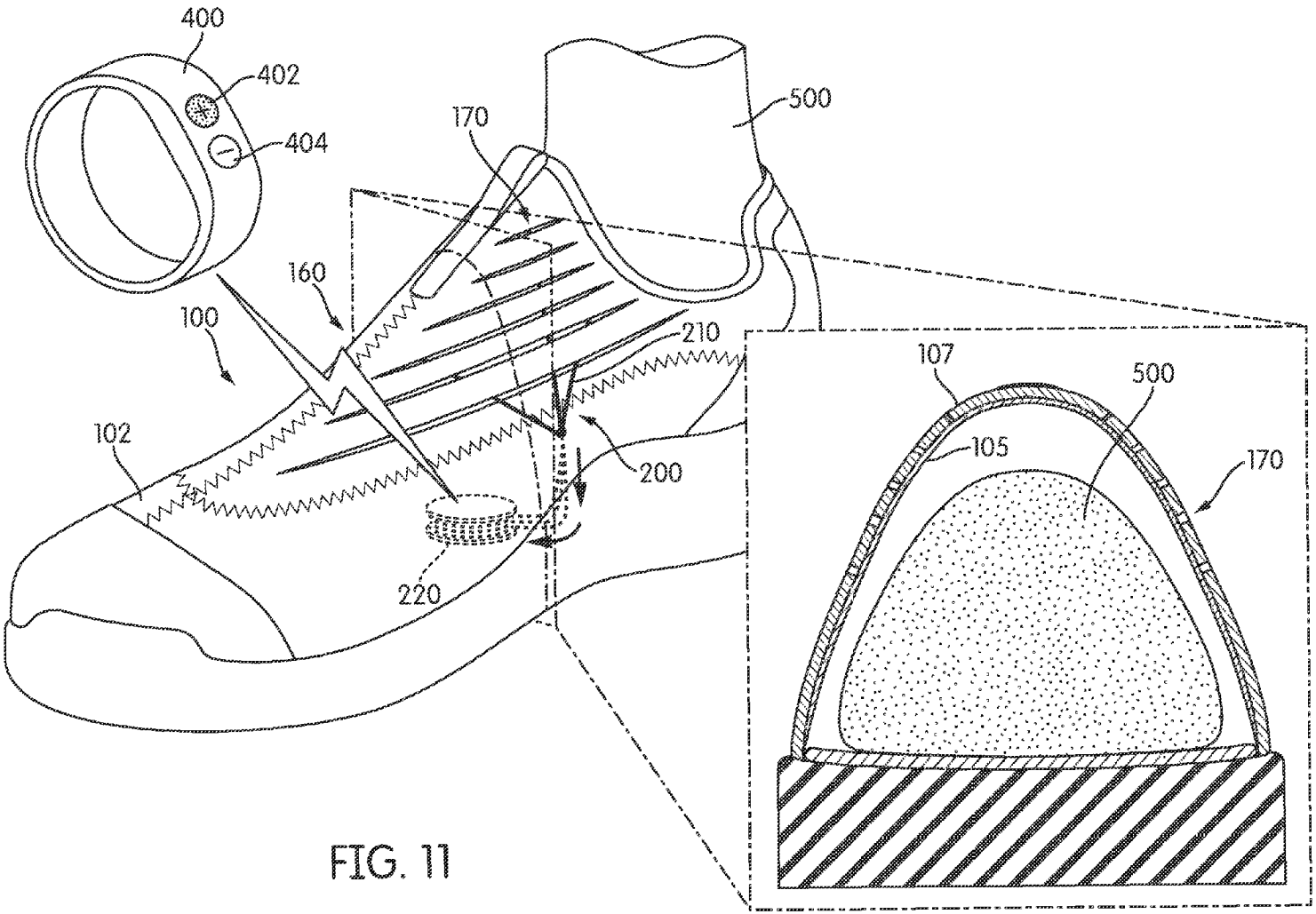
FIG. 11 is a schematic view of an embodiment of an article of footwear with an instep portion starting to contract in volume.
Figure 12:
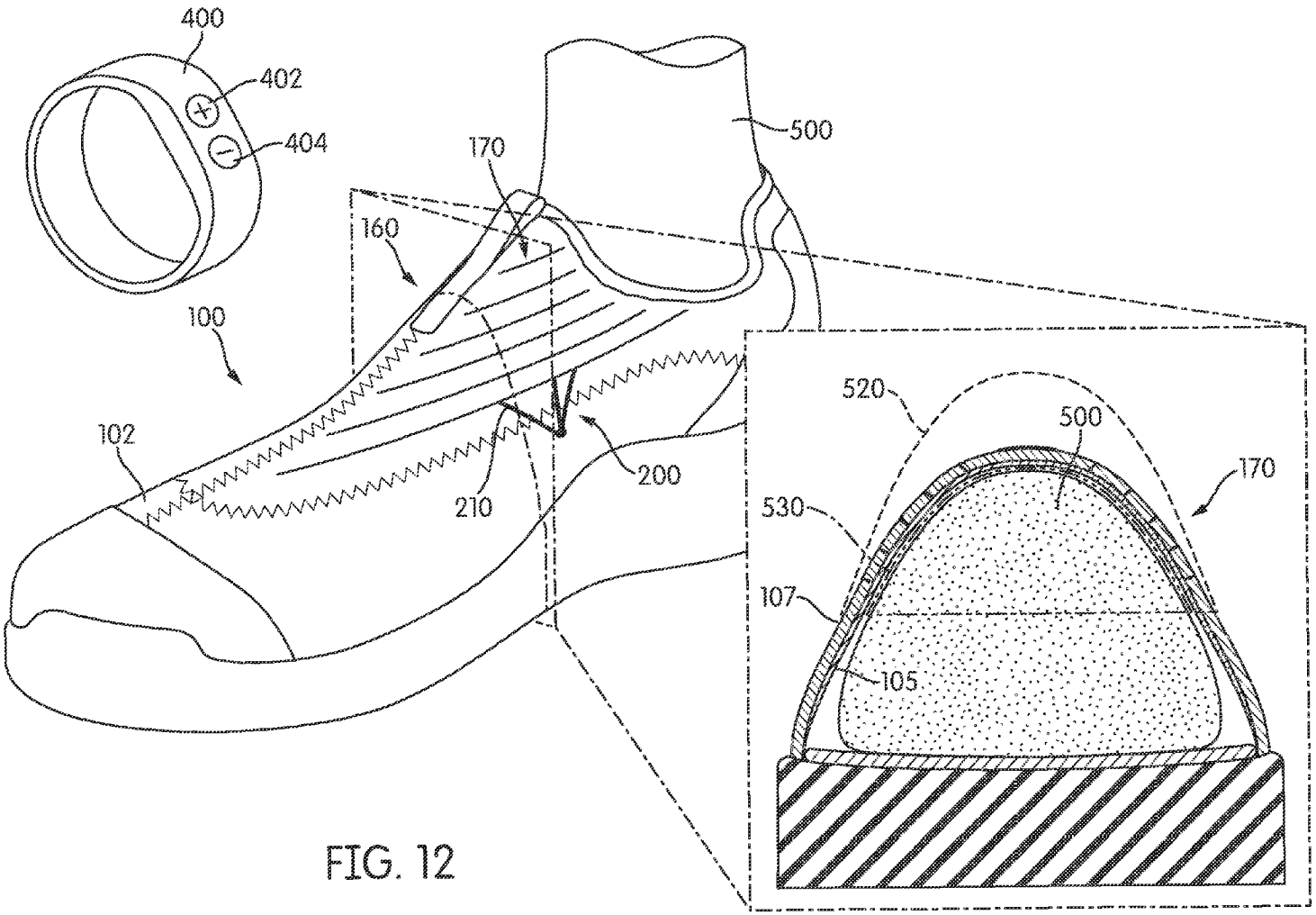
FIG. 12 is a schematic view of an embodiment of an article of footwear with an instep portion in a fully contracted state.

FIGS. 10 through 12 illustrate a sequence of states of article 100 in which tensioning system 200 is used to tighten upper 102. Referring first to FIG. 10, tensioning system 200 is in a fully loosened or minimally tensioned state. In this state, plurality of tensioning members 210 may not substantially restrict the expansion of instep portion 160. Therefore, instep portion 160 is capable of stretching to accommodate foot 500, which has been inserted into upper 102. Specifically, plurality of channels 170 can expand to accommodate an increased volume for instep portion 160. In some cases, this configuration may provide spacing between instep portion 160 and instep 505 of foot 500, as seen in the enlarged cross-section of FIG. 10.

Referring next to FIG. 11, a user may begin to tighten instep portion 160 by pressing tightening button 402. This causes tensioning device 220 to wind plurality of tensioning members 210, thereby applying a generally downward tension to instep portion 160. As plurality of tensioning members 210 pull down in instep portion 160, plurality of channels 170 may decrease in width. This results in a decreased volume for instep portion 160 (and upper 102), as shown in the enlarged cross-section of FIG. 11. In other words, increasing the tension of plurality of tensioning members 170 may act to decrease the volume of instep portion 160.

Generally, tensioning device 220 may continue wind plurality of tensioning members 210 as long as tightening button 402 is pressed (or until a signal that a desired tension level has been achieved). This continued tensioning may act to close plurality of channels 170 until previously separated sections of outer layer 107 come into contact.

A fully tightened state for instep portion 160 (and upper 102 more generally) is shown in FIG. 12. As seen in FIG. 12, the volume of instep portion 160 has been substantially decreased from a first volume 520 (indicated schematically in the cross-section of FIG. 12) to a second volume 530 (indicated schematically in the cross-section of FIG. 12). In particular, first volume 520 represents the approximate volume of instep portion 160 in the fully un-tensioned state seen in FIG. 10, while second volume 530 represents the volume of instep portion 160 in a fully tightened state. It should be clear that while the sections indicated schematically as first volume 520 and second volume 530 are shown as two dimensional sections, these are intended to be indicative of three dimensional volumes bounded from above by instep portion 160.

Although not shown in the figures, a similar process for releasing tension in plurality of tensioning members 170 may occur when a user depresses loosening button 404. This acts to unwind plurality of tensioning members 170 from tensioning device 220, which allows instep portion 160 to increase in volume when forces are applied by the foot to instep portion 160 (or directly by a user grabbing tab portion 175). The degree to which tensioning device 220 is loosened will affect the degree to which instep portion 160 can expand (and therefore the degree to which opening 140 may likewise expand).

In different embodiments, the mechanism that allows the volume of an instep portion to be changed may vary. The embodiments shown in FIGS. 1-12 utilize an instep portion with channels that can increase and decrease in size. However, other embodiments could make use of other provisions that facilitate expansion or contraction of the volume of an instep portion.

Figure 13:
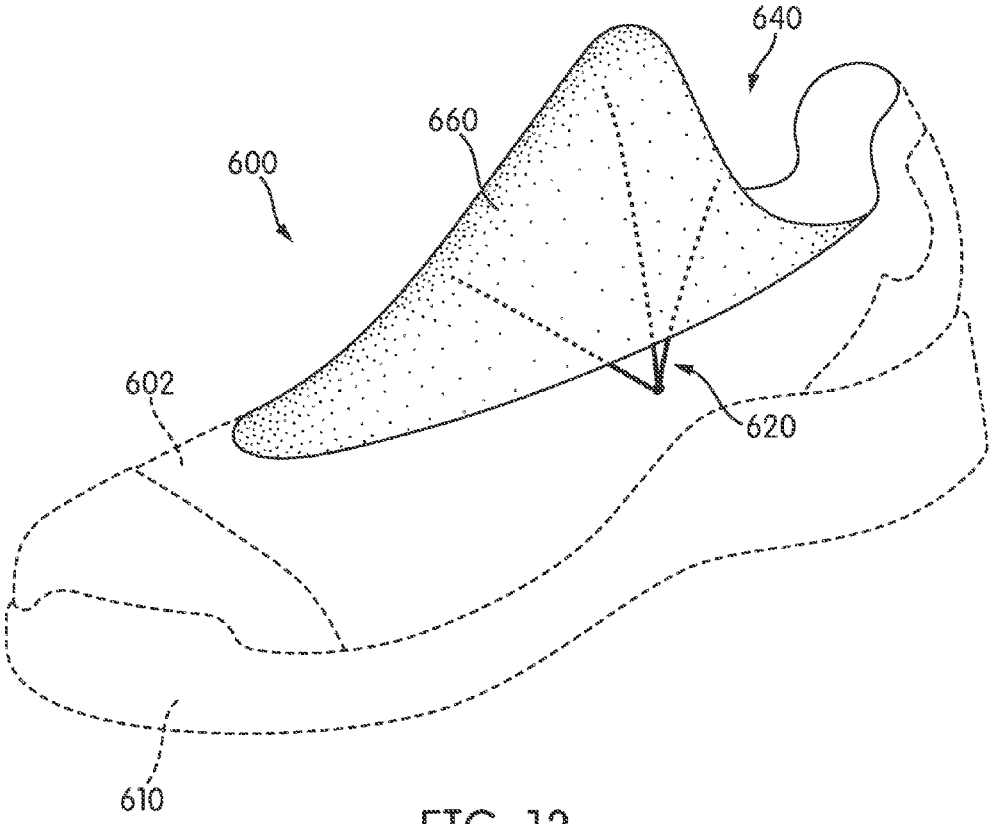
FIG. 13 is a schematic isometric view of an embodiment of an article of footwear with an instep portion in an expanded state.
Figure 14:
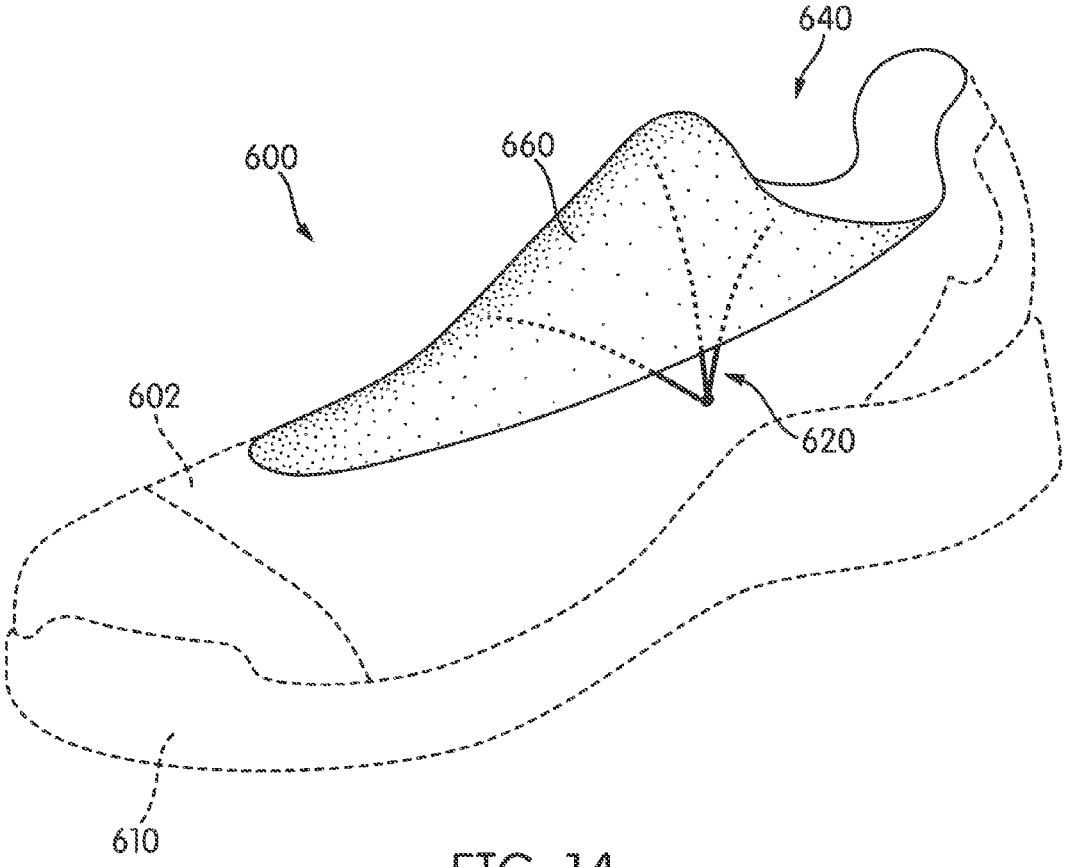
FIG. 14 is a schematic isometric view of an embodiment of an article of footwear with an instep portion in a contracted state.

FIGS. 13 and 14 illustrate a schematic embodiment of an article 600, which includes an upper 602 and a sole structure 610. Article 600 may further include an instep portion 660 having an adjustable volume and an opening 640 that varies in size with instep portion 660. In this embodiment, the structure of instep portion 660 is shown schematically, without depicting a particular mechanism by which instep portion 660 can expand or contract. Generally, such provisions could include channels, slots, pleats, elastic materials, as well as any other mechanical and/or material provisions that would facilitate substantial changes in volume of instep portion 660.

Additionally, in this embodiment, a tensioning system 620 may be used to apply tension to instep portion 660. By increasing the tension applied to instep portion 660, the volume of instep portion 660 can be contracted, as seen when comparing the shape of instep portion 660 in FIG. 13 with the shape of instep portion 660 in FIG. 14.

Figure 15:
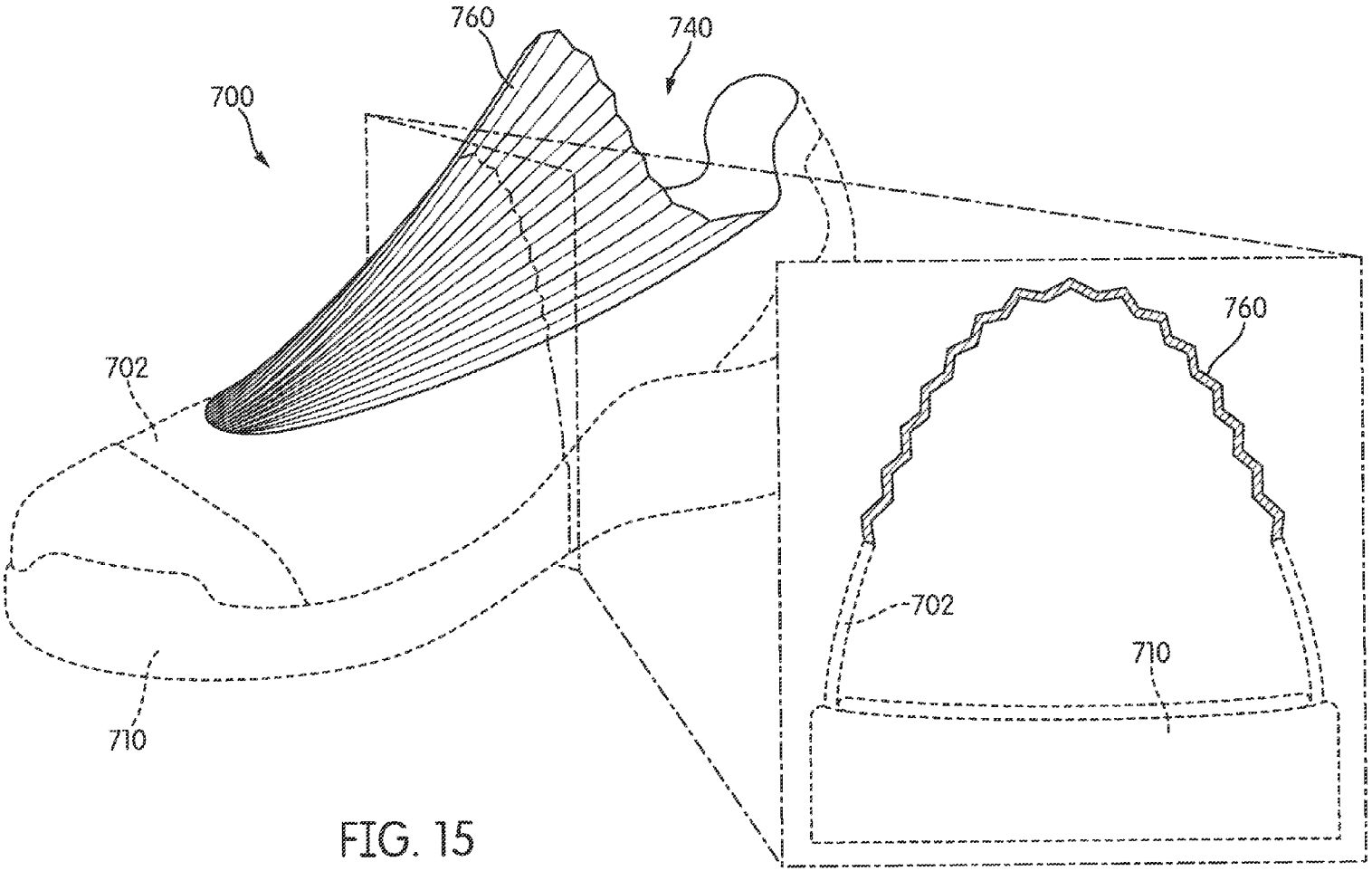
FIG. 15 is a schematic isometric view of another embodiment of an article of footwear with an instep portion in an expanded state.
Figure 16:
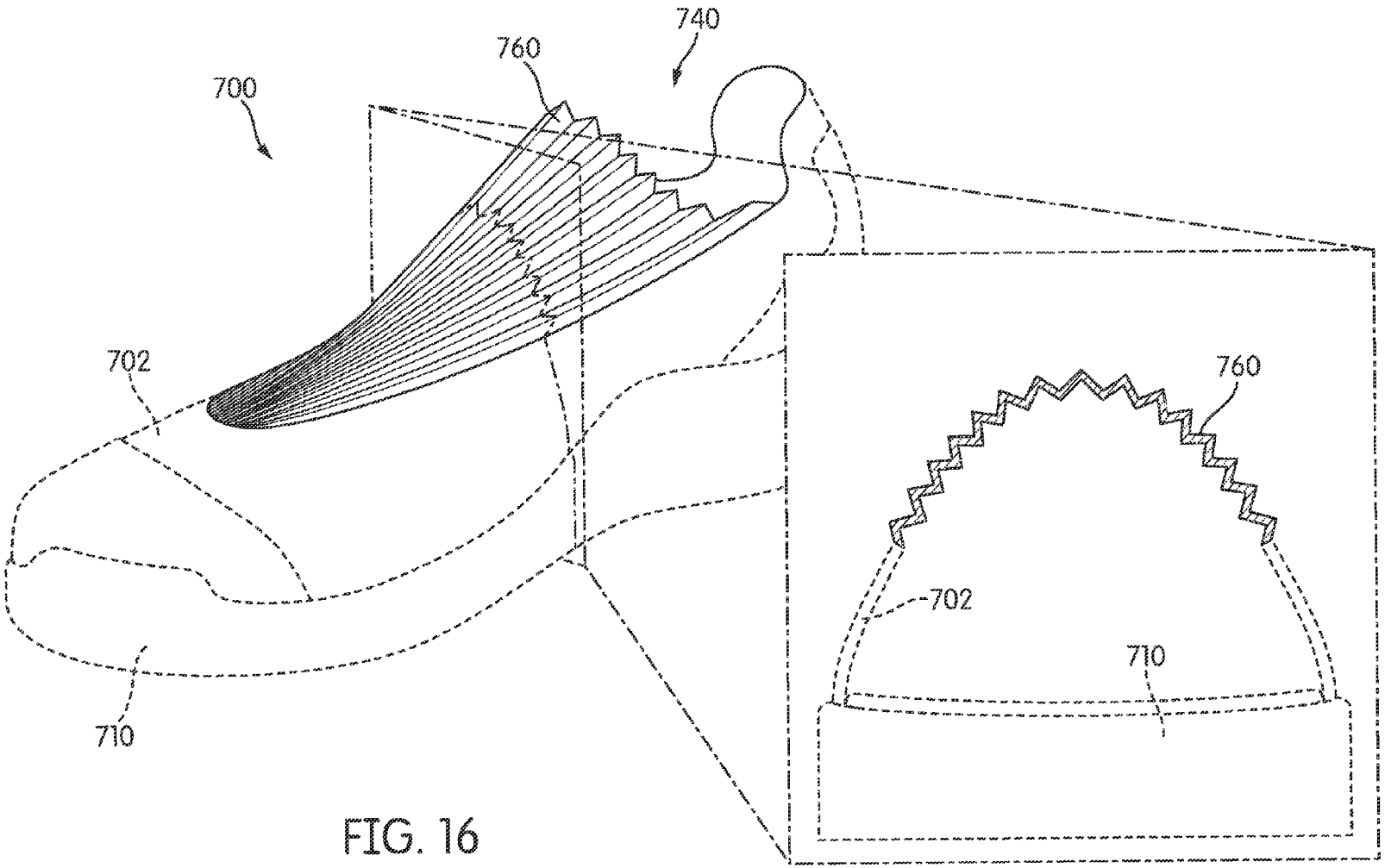
FIG. 16 is a schematic isometric view of another embodiment of an article of footwear with an instep portion in a contracted state.

FIGS. 15 and 16 illustrate still another embodiment of an instep portion with a variable volume. Referring to FIGS. 15 and 16, an article 700 may include an upper 702 and sole structure 710. Upper 702 can include an opening 740 as well as an instep portion 760. In this embodiment, instep portion 760 has a fan-fold geometry. Thus, applying tension across instep portion 760 using a tensioning system (not shown) allows the volume of instep portion 760 to be decreased. Other embodiments could incorporate a section of material having pleats to facilitate expansion and contraction in a similar manner.

Figure 17:
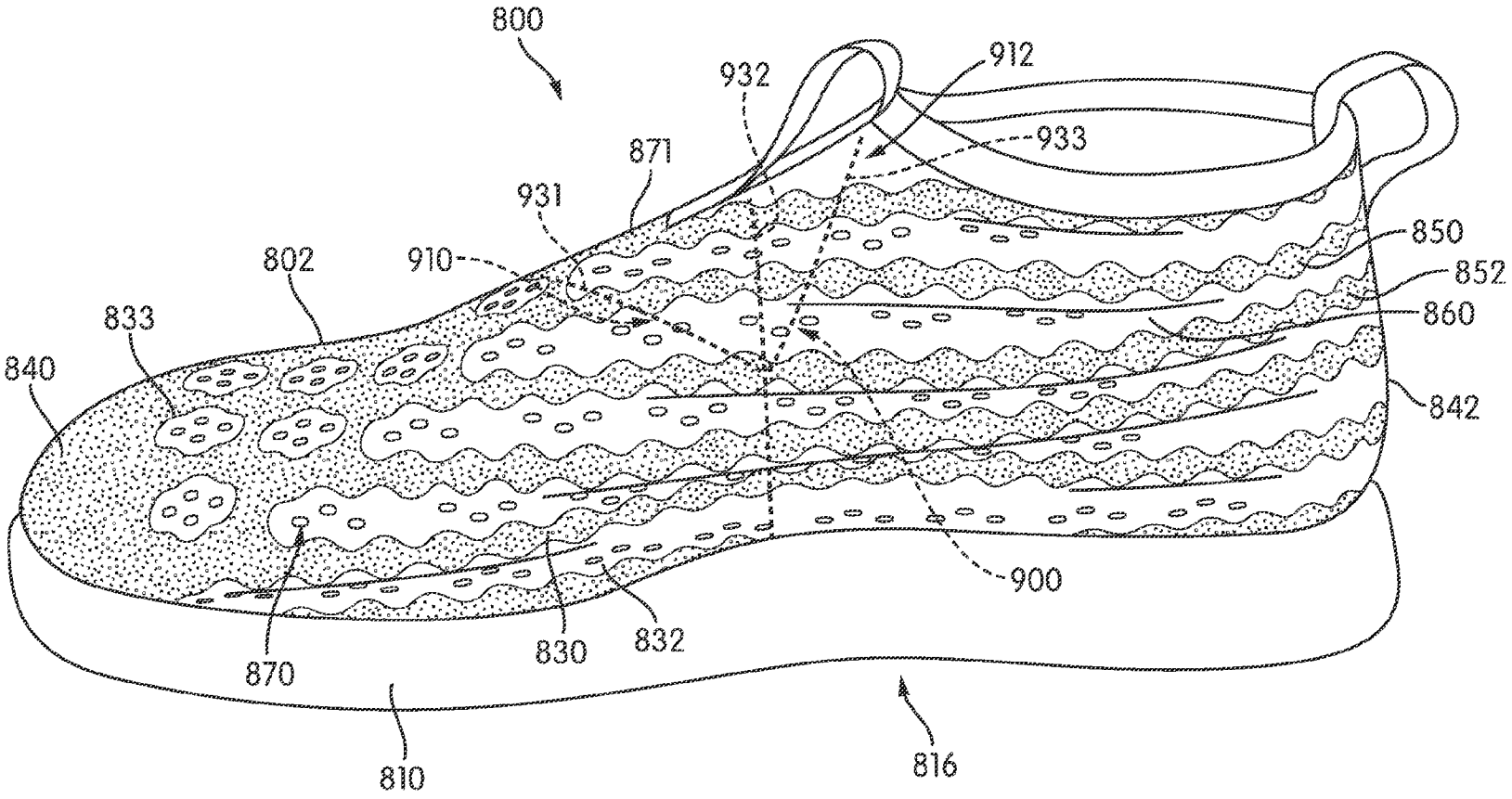
FIG. 17 is a schematic lateral isometric view of another embodiment of an article of footwear.
Figure 18:
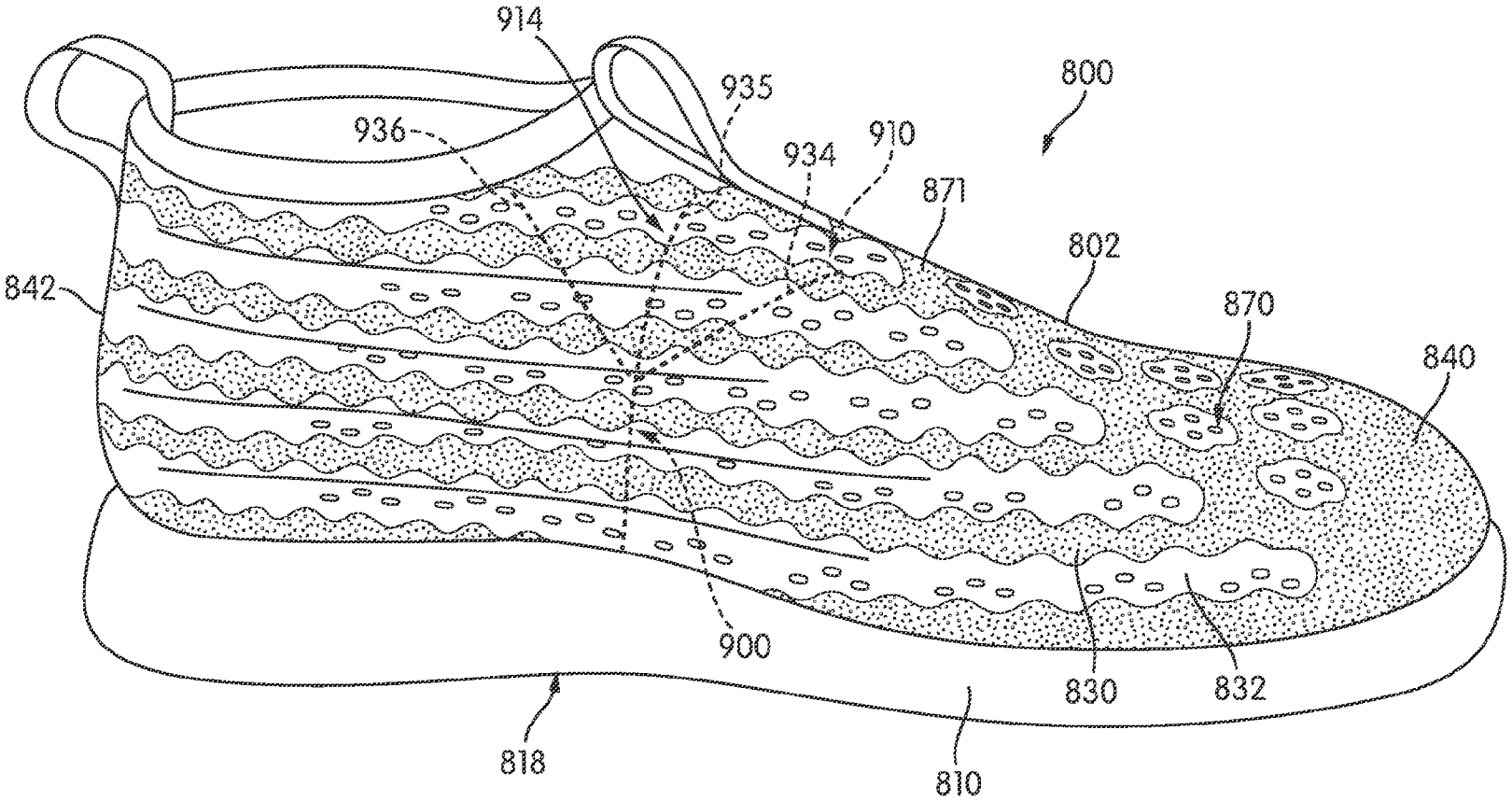
FIG. 18 is a schematic medial isometric view of another embodiment of an article of footwear.

FIGS. 17 and 18 illustrate schematic isometric views of an embodiment of an article of footwear 800 that includes a tensioning system. Article of footwear 800 may include sole structure 810 and upper 802. As with a previous embodiment, article 800 may generally be closed along the top of upper 802, including along instep portion 871. In other words, instep portion 871 may be configured as a closed portion. In particular, instep portion 871 may be closed around the instep of a foot, when a foot has been inserted into article 800.

In some embodiments, a tensioning system 900 may be provided. For purposes of illustration, only some components of tensioning system 900 are shown in the current embodiment. Moreover, in contrast to some previous embodiments, in the embodiment of FIGS. 17-18, the components of tensioning system 900 are not visible on an outer surface of upper 802. In some cases, tensioning system 900 may be similar to the tensioning systems of the earlier embodiments. In particular, tensioning system 900 may include plurality of tensioning members 910.

Plurality of tensioning members 910 may be further grouped into a first group of tensioning members 912 and a second group of tensioning members 914, which are associated with lateral side 816 and medial side 818, respectively, of upper 802. Generally, each group could have any number of tensioning members. In some embodiments, first group of tensioning members 912 and second group of tensioning members 914 may each comprise three distinct tensioning members. However, other embodiments could include any other number of tensioning members in each group of tensioning members, including one, two, three, four or more than four tensioning members. In particular, as seen in FIG. 17, first group of tensioning members 912 may include first tensioning member 931, second tensioning member 932 and third tensioning member 933. Likewise, as seen in FIG. 18, second group of tensioning members 914 may include fourth tensioning member 934, fifth tensioning member 935 and sixth tensioning member 936.

As in the earlier embodiments, the tensioning members in each group may be spread apart over instep portion 871, and may be adjacent one another along the sides of upper 802. Additionally, each tensioning member extends down to a tensioning device (not shown), which applies tension to each tensioning member.

In some embodiments, upper 802 may be configured with provisions to contract in volume under tension, especially in instep portion 871 and adjacent portions. In some embodiments, upper 802 is configured with first set of portions 830 having a first material construction and a second set of portions 832 having a second material construction that is different from the first material construction. For purposes of illustration, an exemplary configuration of first set of portions 830 is shown in FIGS. 17-20 with shading, while an exemplary configuration of second set of portions 832 is shown in FIGS. 17-20 without shading.

In some embodiments, the first set of portions 830 extends through much of toe portion 840. Additionally, first set of portions 830 extend in lengthwise segments from toe portion 840 to heel portion 842. Second set of portions 832 may comprise small disjoint segments 833 within toe portion 840. Additionally, second set of portions 832 includes lengthwise segments that separate adjacent lengthwise portions from first set of portions 830. As an example, as seen in FIG. 17, a first segment 850 and a second segment 852 of first set of portions 830 are separated by a segment 860 of second set of portions 832.

In some embodiments, the first material construction (associated with first set of portions 830) and the second material construction (associated with second set of portions 832) may be substantially different. For example, in some embodiments, the second material construction may be substantially more elastic than the first material construction. In addition, in some embodiments, second set of portions 832 may be associated with plurality of holes 870, which can facilitate breathability for upper 802 and also increase flexibility for second set of portions 832. This configuration for the first material construction and the second material construction may facilitate the contraction of second set of portions 832 as upper 802 is tensioned.

Figure 19:
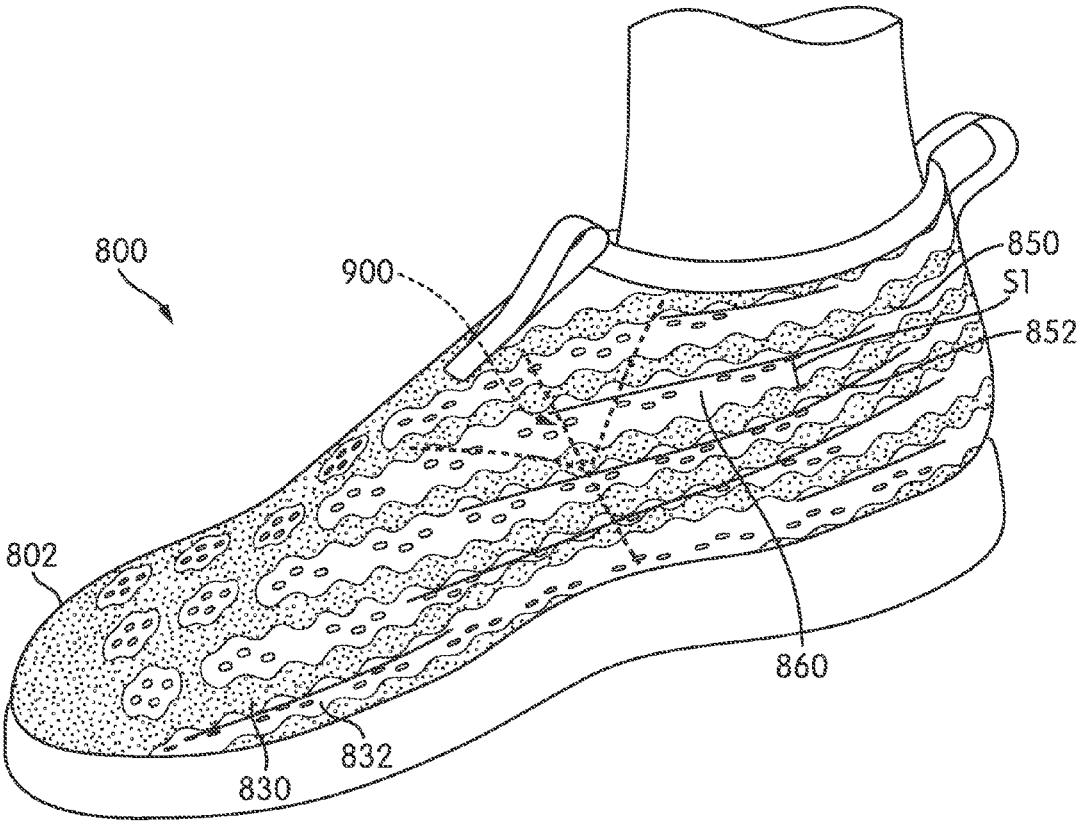
FIG. 19 is a schematic isometric view of the article of footwear of FIG. 17 in an un-tensioned state.
Figure 20:
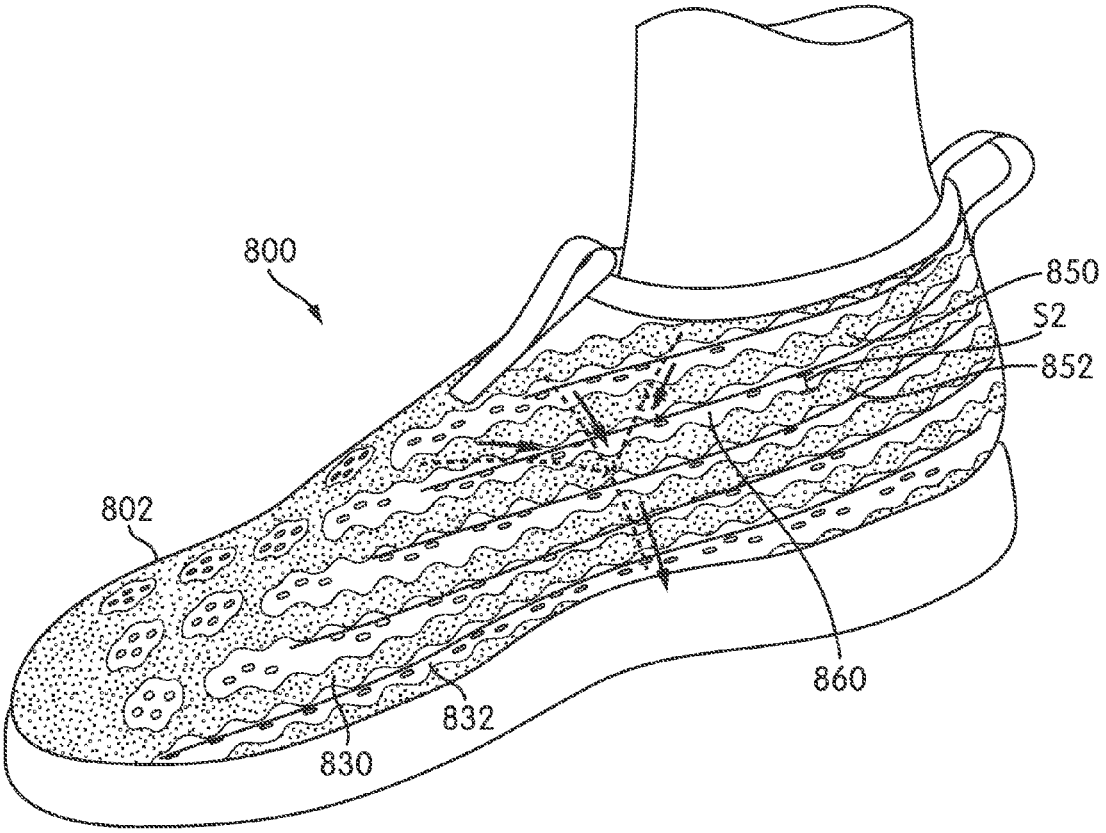
FIG. 20 is a schematic isometric view of the article of footwear of FIG. 17 in a tensioned state.

FIGS. 19 and 20 illustrate schematic isometric views of article 800 in an un-tensioned state and a tensioned state, respectively. As seen in FIG. 19, prior to tensioning upper 802 using tensioning system 900, the alternating lengthwise segments of second set of portions 832 are expanded in the widthwise direction of each segment. However, as tension is applied via tensioning system 900, the lengthwise segments of second set of portions 832 begin to contract in the widthwise direction. Thus, as seen in comparing FIGS. 19 and 20, the relative spacing between adjacent lengthwise segments of first set of portions 830 decreases. For example, segment 850 and segment 852, may be initially separated by an average spacing S1 as shown in FIG. 19. However, as segment 860 contracts, segment 850 and segment 852 are separated by an average spacing S2 that is substantially less than average spacing S1. As the spacing between adjacent segments of first set of portions 830 is decreased, the overall volume enclosed within upper 802 is decreased. This results in a tightened fit for upper 802 around a wearer's foot.

In different embodiments, the geometry of different portions of article 800 could vary. In an exemplary embodiment, lengthwise segments of first set of portions 830 and second set of portions 832 may generally have curved or non-linear edges. In some cases, the lengthwise segments of first set of portions 830 and second set of portions 832 have corresponding wavy edges, including alternating crests and troughs. In some embodiments, segments of first set of portions 830 that are separated by a corresponding segment from second set of portions 832 could be configured so that the crests of each segment are approximately aligned in a longitudinal direction. In such an embodiment, the crests of the segments of first set of portions 830 could come into contact with one another as second set of portions 832 contract under tension. In other embodiments, segments of first set of portions 830 that are separated by a corresponding segment from second set of portions 832 could be configured so that a crest of one segment is aligned with a trough of another segment in the longitudinal direction. In such an embodiment, the crests of one segment may fit into the troughs of another segment as second set of portions 832 contract under tension. By varying the alignment of adjacent segments from first set of portions 830, the overall fit of article 800 during a contracted or tensioned state can be tuned.

Figure 21:
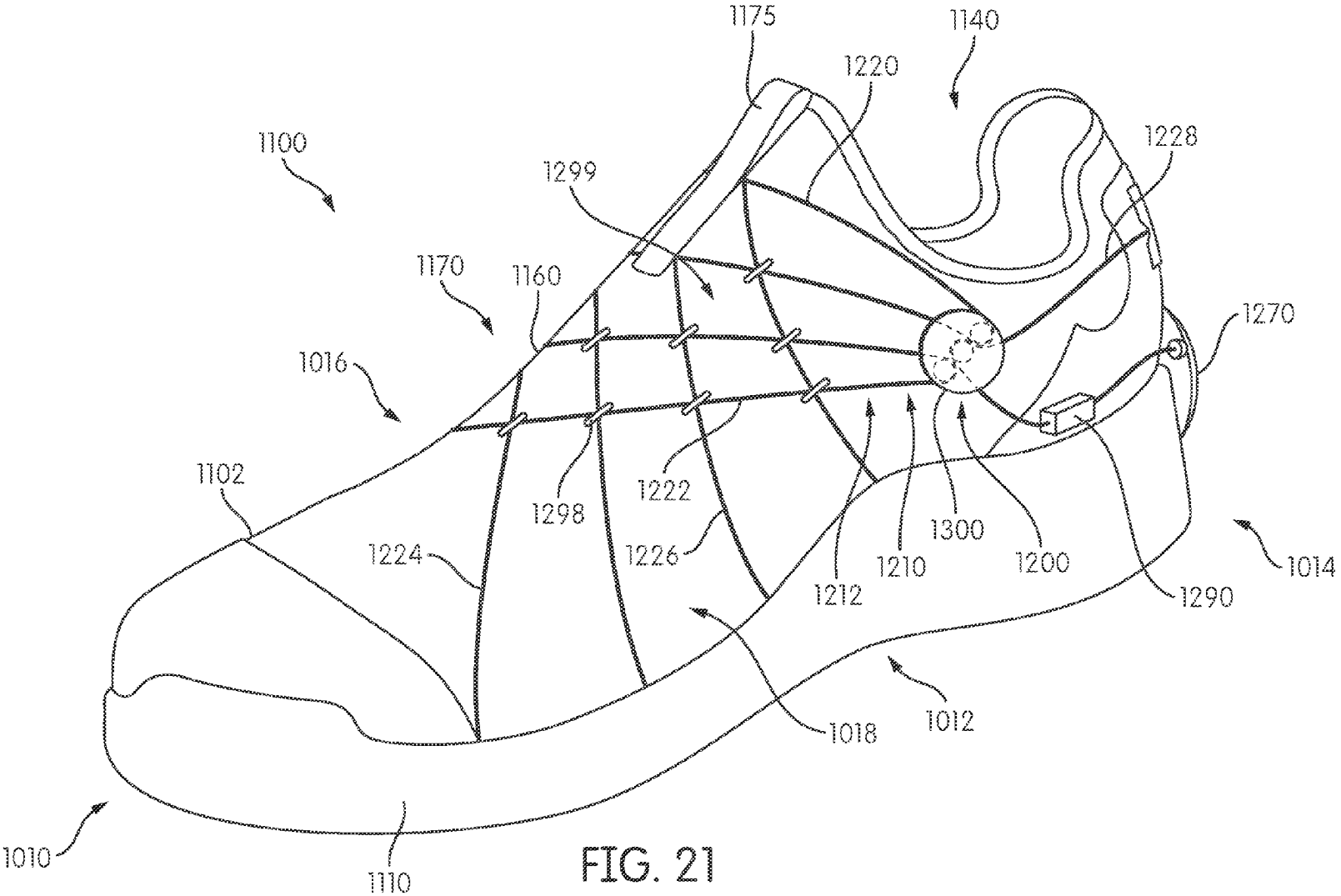
FIG. 21 is a medial isometric view of an embodiment of an article of footwear including a tensioning system.
Figure 22:
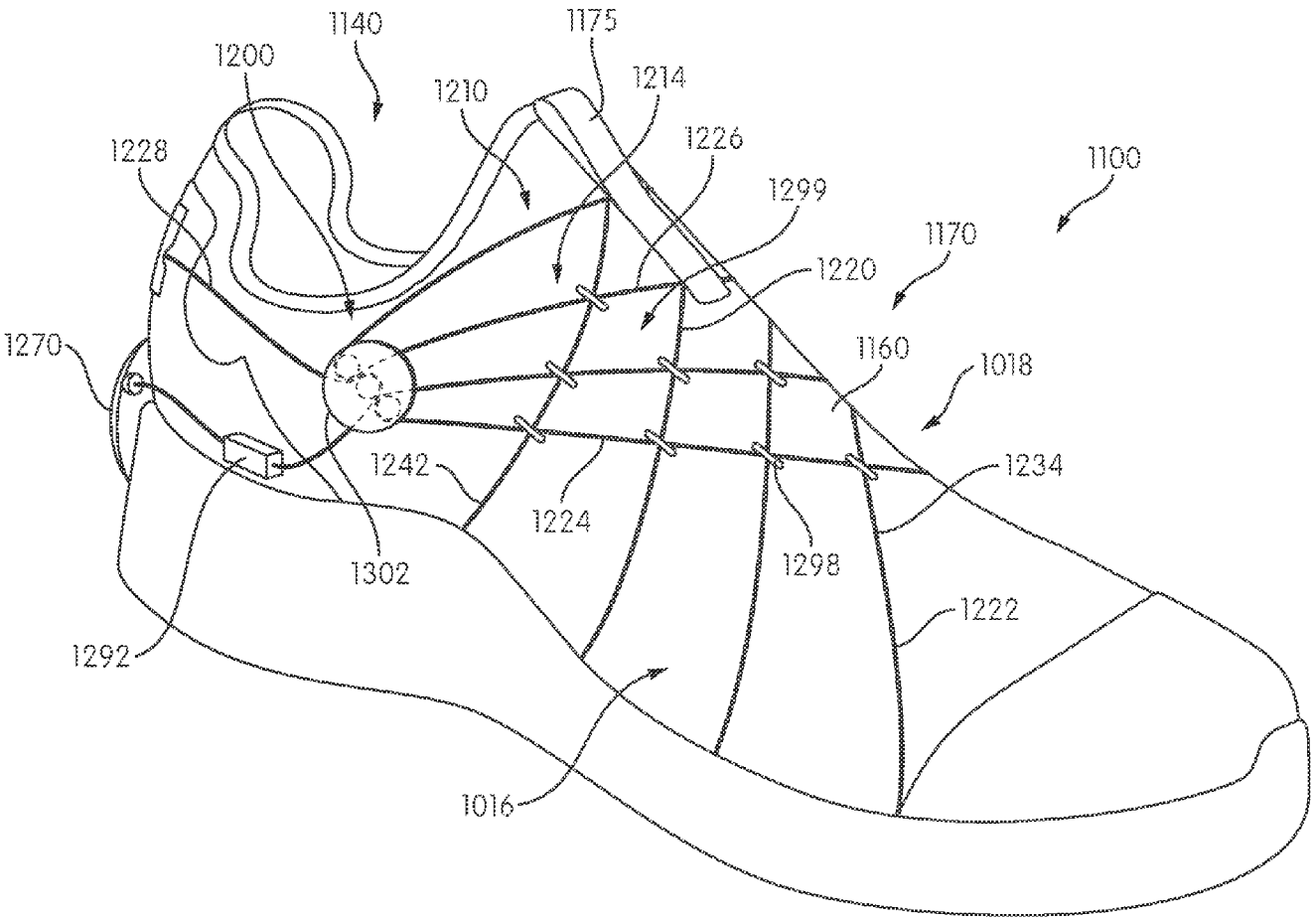
FIG. 22 is a lateral isometric view of an embodiment of an article of footwear including a tensioning system.

FIGS. 21 and 22 illustrate schematic isometric views of an embodiment of an article of footwear 1100, also referred to simply as article 1100. Article 1100 may configured as various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 1100 may be configured as various kinds of non-sports related footwear, including, but not limited to: slippers, sandals, high heeled footwear, loafers as well as any other kinds of footwear, apparel and/or sporting equipment (e.g., gloves, helmets, etc.).

It will be understood that article of footwear 1100 may be configured with any of the provisions, features, systems and/or components which have already been described in previous embodiments and shown in FIGS. 1-20. For purposes of clarity, some of these features may be discussed with respect to the embodiments shown in FIGS. 21-37, but not all features may be discussed. However, any of the features discussed in each embodiment of the disclosure could be optionally part of any other embodiment, such that features of different embodiments can be combined in any manner.

Referring to FIG. 21, for purposes of reference, article 1100 may be divided into forefoot portion 1010, midfoot portion 1012 and heel portion 1014. Forefoot portion 1010 may be generally associated with the toes and joints connecting the metatarsals with the phalanges. Midfoot portion 1012 may be generally associated with the arch of a foot. Likewise, heel portion 1014 may be generally associated with the heel of a foot, including the calcaneus bone. In addition, article 1100 may include lateral side 1016 and medial side 1018. In particular, lateral side 1016 and medial side 1018 may be opposing sides of article 1100. Furthermore, both lateral side 1016 and medial side 1018 may extend through forefoot portion 1010, midfoot portion 1012 and heel portion 1014.

Article 1100 may include an upper 1102 as well as a sole structure 1110. In some embodiments, sole structure 1110 may be configured to provide traction for article 1100. In addition to providing traction, sole structure 1110 may attenuate ground reaction forces when compressed between the foot and the ground during walking, running or other ambulatory activities. The configuration of sole structure 1110 may vary significantly in different embodiments to include a variety of conventional or non-conventional structures. In some cases, the configuration of sole structure 1110 can be configured according to one or more types of ground surfaces on which sole structure 1110 may be used. Examples of ground surfaces include, but are not limited to: natural turf, synthetic turf, dirt, as well as other surfaces.

Generally, upper 1102 may be any type of upper. In particular, upper 1102 may have any design, shape, size and/or color. For example, in embodiments where article 1100 is a basketball shoe, upper 1102 could be a high top upper that is shaped to provide high support on an ankle. In embodiments where article 1100 is a running shoe, upper 1102 could be a low top upper.

In some embodiments, upper 1102 includes opening 1140 that provides entry for the foot into an interior cavity of upper 1102. Opening 1140 may be bounded from a rearward direction by heel portion 1014 of upper 1102. In some embodiments, upper 1102 further includes an instep portion 1160 that corresponds to the top of a foot.

In contrast to some other upper configurations, article 1100 may generally be closed along the top of upper 1102, including along instep portion 1160. In other words, instep portion 1160 may be configured as a closed portion. In particular, instep portion 1160 may be closed around the instep of a foot, when a foot has been inserted into article 1100.

Upper 1102 may further be associated with an intermediate covering portion 1170. In a similar manner to the embodiment described above and shown in FIG. 5, intermediate covering portion 1170 may be associated with a corresponding interior volume. As portions of article 1100 are expanded and contracted in response to changes in tension of various tensioning members, the interior volume of intermediate covering portion 1170 may generally change accordingly. Thus, for example, as portions of article 1100 contract with increased tension, the interior volume of intermediate covering portion 1170 may decrease. Likewise, as portions of article 1100 expand with decreased tension, the interior volume of intermediate covering portion 1170 may increase.

In order to facilitate entry of a foot into upper 1102, intermediate covering portion 1170 may include provisions for expanding and contracting, especially at instep portion 1160, which may be part of intermediate covering portion 1170.

For purposes of clarity, article 1100 is illustrated schematically without details regarding provisions for expanding and/or contracting at instep portion 1160. However, it will be understood that other embodiments may utilize a variety of different provisions to facilitate the expansion and contraction of portions of an upper. Some embodiments may use a material having slots or other narrow openings, such as those that have been described above and depicted in FIGS. 10-12, for example. Other embodiments could use materials constructed with a fan-fold geometry, as described above and shown in FIGS. 15-16. Still other embodiments could use material constructions as shown in FIGS. 17-20, in which strips of alternating materials having different characteristics are used to facilitate expansion and contraction of an upper. Moreover, other embodiments could use any other means that allows instep portion 1160 (as well as possibly other portions of upper 1102) to expand and contract, thereby changing the volume of intermediate covering portion 1170.

Figure 23:
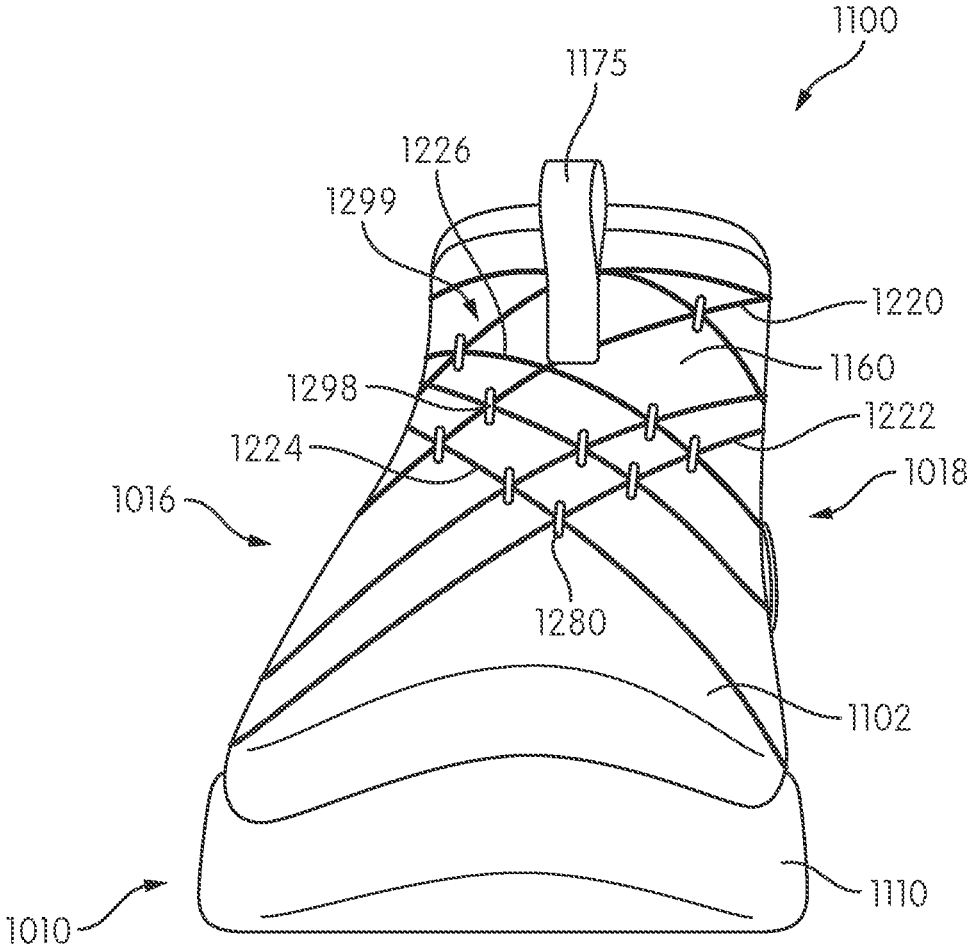
FIG. 23 is a front view of an embodiment of an article of footwear including a tensioning system.

FIG. 23 illustrates a front view of article 1100, including components of a tensioning system. Referring now to FIGS. 21-23, some embodiments may include tab portion 1175. In some embodiments, tab portion 1175 is a tab-like portion disposed along the top of instep portion 1160. In some embodiments, tab portion 1175 has a looped geometry that can be easily grasped with a finger. In some cases, tab portion 1175 may be disposed adjacent to opening 1140. Tab portion 1175 may be grasped and pulled by a user to expand instep portion 1160. This allows opening 1140 to increase in size temporarily, thereby permitting entry of a foot through opening 1140. With tab portion 1175 released, instep portion 1160 may return to a pre-tensioned size and/or volume.

Embodiments can include provisions to facilitate contracting intermediate covering portion 1170 (and thereby reducing its volume) once a foot has been inserted in order to tighten the fit of upper 1102 to the foot. In some embodiments, article 1100 may include tensioning system 1200 that may provide tension across instep portion 1160. Tensioning system 1200 may further comprise one or more tensioning members as well as a tensioning device. Examples of possible tensioning members that could be used include, but are not limited to: cables, wires, strings, laces, straps, belts, ribbons, chains, rods as well as any other kinds of tensioning members. Moreover, exemplary tensioning devices include, but are not limited to: winding devices (e.g., reels and spools), springs, as well as any other devices, systems or components that can be used to apply tension to any portion of a tensioning member.

In some embodiments, tensioning system 1200 may include plurality of tensioning members 1210. Plurality of tensioning members 1210 may comprise cable-like or wire-like members. In particular, the tensioning members of the current embodiment may be characterized as being approximately one-dimensional. In other words, each tensioning member may generally have a length that is substantially greater than the width, thickness and/or diameter of the tensioning member. In other embodiments, however, one or more tensioning members could be approximately two-dimensional members (e.g., ribbons, belts or straps).

Tensioning system 1200 may be configured with tensioning members linked together in a parallel and/or serial manner. In particular, tensioning system 1200 may include some tensioning members that directly engage (i.e., apply tension directly to) portions of upper 1102 and tensioning system 1200 may also include some tensioning members that transfer forces between the directly engaged tensioning members and a power source, such as a tensioning device. For purposes of clarity, tensioning members that directly engage (e.g., pull and/or compress) upper 1102 are referred to as driven tensioning members, while tensioning members that pull on the driven tensioning members are referred to as driving tensioning members. However, it will be understood that these labels are only intended for purpose of clarity and that both driving tensioning members and driven tensioning members could be configured as similar material elements (e.g., wires, cables, ropes, laces, etc.). Thus, in the illustrated embodiments, driving tensioning members may act to transfer tension between a tensioning device and one or more driven tensioning members. In other words, driving tensioning members may pull on driven tensioning members, while the driven tensioning members directly apply tension to (e.g., pull) on portions of upper 1102.

In certain embodiments shown in FIGS. 21-23, plurality of tensioning members 1210 may comprise four driven tensioning members that extend through various portions of upper 1102. Specifically, the exemplary embodiment includes a first set of tensioning members 1212, which includes first driven tensioning member 1220 and second driven tensioning member 1222. Additionally, the exemplary embodiment includes a second set of tensioning members 1214, which includes third driven tensioning member 1224 and fourth driven tensioning member 1226. First driven tensioning member 1220, second driven tensioning member 1222, third driven tensioning member 1224 and fourth driven tensioning member 1226 all extend through upper 1102 in order to help fasten upper 1102 around a foot.

In some embodiments, tensioning system 1200 further includes at least one driving tensioning member, which may transfer tension between a tensioning device and one or more driven tensioning members. In some embodiments, tensioning system 1200 could include two or more driving tensioning members. In the exemplary embodiment shown in FIGS. 21-26, tensioning system 1200 includes a single driving tensioning member 1228. Driving tensioning member 1228 may be further associated with each of first driven tensioning member 1220, second driven tensioning member 1222, third driven tensioning member 1224 and fourth driven tensioning member 1226.

Figure 24:
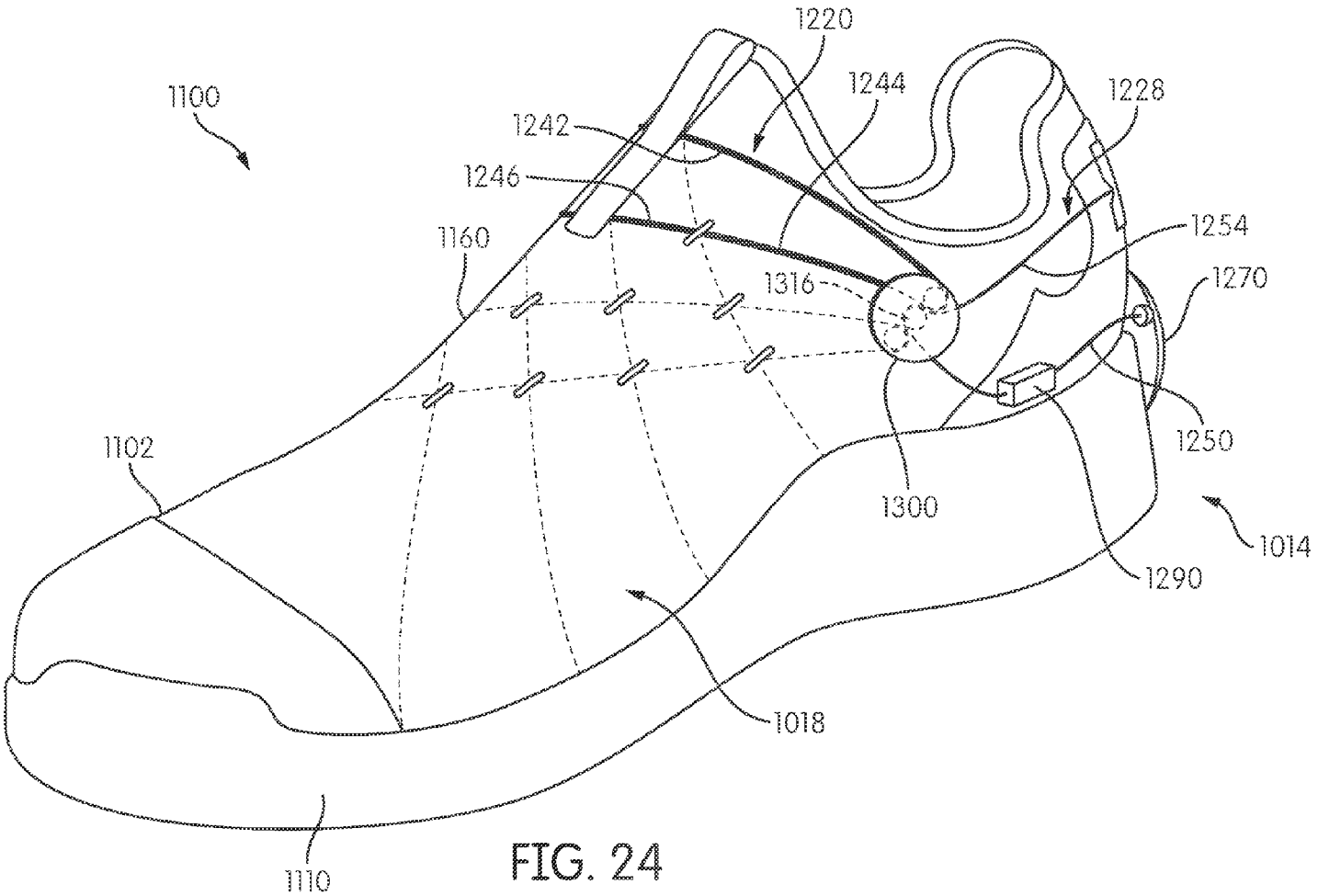
FIG. 24 is a medial isometric view of the article of footwear of FIG. 21, in which a single driven tensioning member is highlighted.
Figure 25:
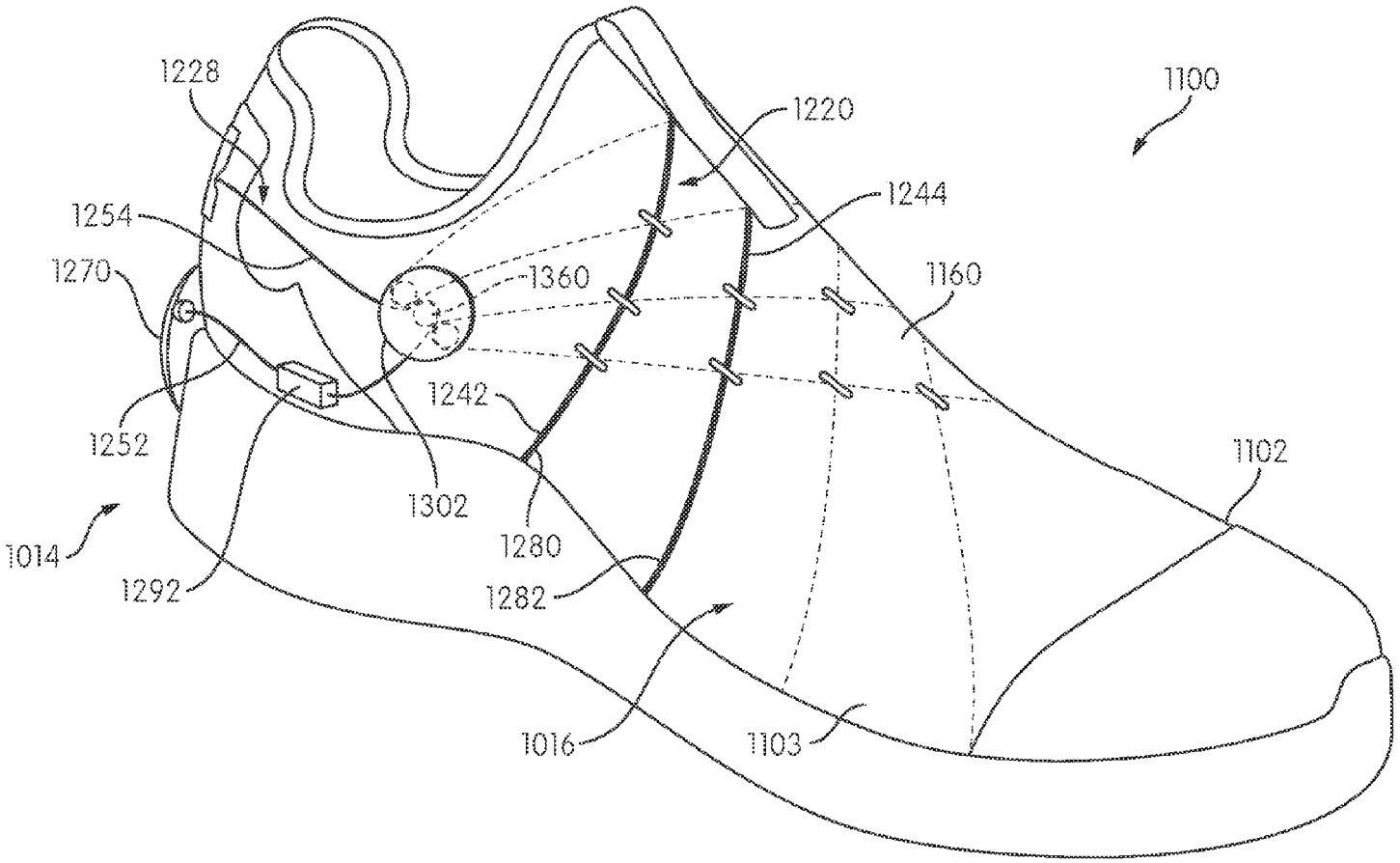
FIG. 25 is a lateral isometric view of an embodiment of the article of footwear of FIG. 22, in which a single driven tensioning member is highlighted.

In order to best illustrate the different portions and arrangement of driven tensioning members and of the driving tensioning member, FIGS. 24 and 25 illustrate medial and lateral schematic isometric views of article 1100, in which only some tensioning members are highlighted. Specifically, first driven tensioning member 1220 and driving tensioning member 1228 are highlighted in FIGS. 24-25 to provide improved clarity.

Generally, each driven tensioning member has a first portion, a second portion and a third portion. The first portion and the third portion may extend through upper 1102, including through instep portion 1160 (and intermediate covering portion 1170). The second portion may be disposed between the first portion and the third portion.

For example, as shown in the embodiment depicted in FIGS. 24 and 25, first driven tensioning member 1220 includes a first portion 1242, a second portion 1244 and a third portion 1246. In this case, first portion 1242 and third portion 1246 extend through upper 1102. Specifically, first portion 1242 extends from medial side 1018 of upper 1102, through instep portion 1160 and over through lateral side 1016. Similarly, third portion 1246 also extends from medial side 1018 of upper 1102, through instep portion 1160 and over through lateral side 1016. Second portion 1244 is disposed between first portion 1242 and third portion 1246. Each of second driven tensioning member 1224, third driven tensioning member 1226 and fourth driven tensioning member 1228 may include similar portions.

Generally, driven tensioning members may be attached or joined with article 1100 in any manner. In some embodiments, the ends of a driven tensioning member may be permanently attached, or fixed, to portions of upper 1102 and/or of sole structure 1110. In certain embodiments, shown in FIGS. 21-22 and in FIGS. 24-25, the ends of each driven tensioning member are permanently attached to article 1100 at the interface between upper 1102 and sole structure 1110. For example, as clearly depicted in FIG. 25, first driven tensioning member 1220 has a first end 1280 attached to article 1100 at a lower periphery 1103 of upper 1102. Likewise, first driven tensioning member 1220 has a second end 1282 attached to article 1100 at lower periphery 1103. The attachment of first end 1280 and second end 1282 to upper 1102 could be achieved using any attachment means known in the art including, but not limited to: stitching, adhesives, knots, welding and/or any other kinds of attachment methods. Moreover, it will be understood that each of second driven tensioning member 1222, third driven tensioning member 1224 and fourth driven tensioning member 1224 may also have ends that are attached to lower periphery 1103 of upper 1102.

In the exemplary embodiment of FIGS. 21-25, only the end portions of each driven tensioning member may be attached in a permanent manner to article 1100. However, in some other embodiments, additional portions of a driven tensioning member could be attached to article 1100. For example, in an alternative embodiment, portions of a driven tensioning member that are disposed in instep portion 1160 may be attached directly to instep portion 1160 of upper 1102. Varying the locations at which portions of a driven tensioning member may be attached to article 1100 (e.g., upper 1102) may alter how upper 1102 is fastened around a foot. It will therefore be appreciated that the attachment locations for driven tensioning members can be selected to achieve desired fastening characteristics for article 1100. In still other embodiments, for example, the ends of a driven tensioning member could be fixed to sole structure 1110, rather than to upper 1102.

Figure 26:
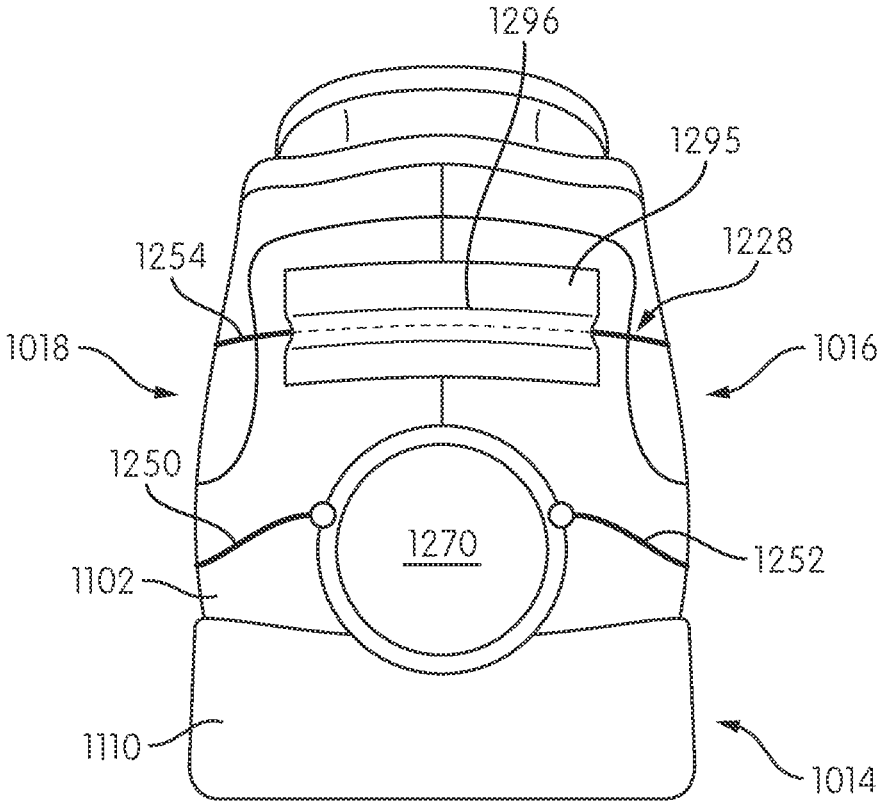
FIG. 26 is a rear view of an embodiment of an article of footwear including a tensioning system.

As shown in FIGS. 24-26, driving tensioning member 1228 may include a first portion 1250, a second portion 1252 and an intermediate portion 1254 that extends between portion 1250 and second portion 1252. First portion 1250 and second portion 1252 may be associated with a tensioning device. Intermediate portion 1254 may extend through upper 1102 and may further be associated with one or more driven tensioning members.

Referring again to FIGS. 21-22 and 24-26, tensioning system 1200 further includes tensioning device 1270 that may be used to adjust the tension in plurality of tensioning members 1210. For purposes of clarity, tensioning device 1270 is shown schematically in the current embodiments. However, tensioning device 1270 may generally include provisions for receiving and winding tensioning members. Examples of different tensioning devices include, but are not limited to: reel devices with a ratcheting mechanism, reel devices with a cam mechanism, manual tensioning devices, automatic tensioning devices, as well as possibly other kinds of tensioning devices. Examples of a tensioning device comprising a reel and ratcheting mechanism that could be used with the current embodiments are disclosed in Soderberg et al., U.S. Patent Application Publication Number 2010/0139057, now U.S. patent application Ser. No. 12/623,362, filed Nov. 20, 2009 and titled "Reel Based Lacing System", the entirety of which is hereby incorporated by reference. Examples of a motorized tensioning device that could be used with the current embodiments are disclosed in Beers, U.S. Patent Publication Number 2014/0070042, published Mar. 13, 2014, and filed as U.S. patent application Ser. No. 14/014,555, on Aug. 30, 2013, and titled "Motorized Tensioning System with Sensors", the entirety being incorporated by reference herein. In an exemplary embodiment, tensioning device 1270 could be a reel-based tensioning device that winds the tensioning members onto a reel to increase the tension.

In different embodiments, the location of tensioning device 1270 could vary. In some embodiments, tensioning device 1270 could be disposed in a portion of upper 1102. In other embodiments, tensioning device 1270 could be disposed in a portion of sole structure 1110. In an exemplary embodiment, tensioning device 1270 may be mounted to heel portion 1014 of article 1100 at upper 1102. Moreover, in the illustrated embodiment, tensioning device 1270 includes an outer casing that may enclose a winding mechanism (not shown).

Embodiments can include provisions to balance the tension applied to two or more driven tensioning members by a driving tensioning member, such that the loads across upper 1102 are more evenly distributed. In some embodiments, a tensioning system may incorporate a tension balancing member. The term "tension balancing member" as used throughout this detailed description refers to any component, device or system that facilitates the balancing of tension across different driven tensioning members and/or across different portions of a single driven tensioning member.

In certain embodiments, shown in FIGS. 21-22, tensioning system 1200 may include a first tension balancing member 1300 and a second tension balancing member 1302. First tension balancing member 1300 may be disposed on medial side 1018 of article 1100, while second tension balancing member 1302 may be disposed on lateral side 1016 of article 1100. First tension balancing member 1300 is further configured to receive a portion of driving tensioning member 1228. First tension balancing member 1300 is also configured to receive a portion of first driven tensioning member 1220 and a portion of second driven tensioning member 1222. Second balancing member 1302 is also configured to receive a portion of driving tensioning member 1228. Second balancing member 1302 is further configured to receive a portion of third driven tensioning member 1224 and a portion of fourth driven tensioning member 1226.

Figure 28:
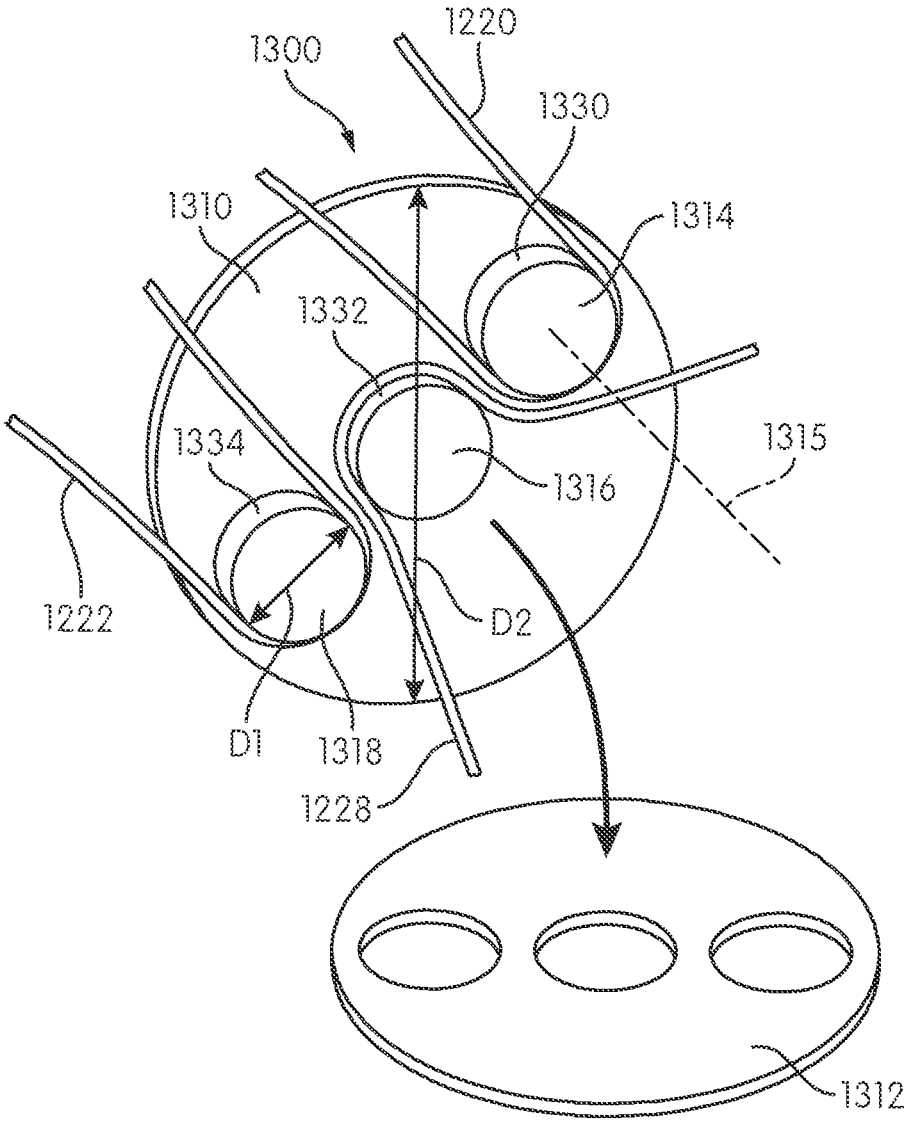
FIG. 28 is a schematic isometric exploded view of an embodiment of a tension balancing member.

The detailed configuration of one particular embodiment of first tension balancing member 1300 may be best understood with reference to FIG. 28, which is an isometric exploded view of first tension balancing member 1300 as well as some portions of first driven tensioning member 1220, second driven tensioning member 1222 and driving tensioning member 1228. Referring to FIG. 28, first tension balancing member 1300 may be comprised of a first sidewall portion 1310 and a second sidewall portion 1312. First tension balancing member 1300 may also include a multiple post portions that extend between first sidewall portion 1310 and second sidewall portion 1312. Specifically, in the embodiment depicted in FIG. 28, first tension balancing member 1300 includes first post portion 1314, second post portion 1316 and third post portion 1318.

Each post portion may be configured to receive at least one tensioning member. For example, first post portion 1314 is configured to receive a portion of first driven tensioning member 1220. More specifically, in some embodiments, first driven tensioning member 1220 may loop, or wrap, around at least some of first post portion 1314. Second post portion 1316 may be configured to receive a portion of driving tensioning member 1228. More specifically, in some embodiments, driving tensioning member 1228 may loop, or wrap, around at least some of second post portion 1316. Third post portion 1318 may be configured to receive a portion of second driven tensioning member 1222. More specifically, in some embodiments, second driven tensioning member 1222 may loop, or wrap, around at least some of third post portion 1318. It will be further appreciated that first sidewall portion 1310 and second sidewall portion 1312 may constrain the motions of each tensioning member so that the tensioning members cannot move substantially along an axial direction of the post portions, and also prevent the tensioning members from sliding off of the post portions. For example, first sidewall portion 1310 and second sidewall portion 1312 act to prevent first driven tensioning member 1220 from translating substantially in a direction oriented along a central axis 1315 of first post portion 1314.

In different embodiments, the geometry of one or more post portions of a tension balancing member could vary. Exemplary geometries that could be used include, but are not limited to: rounded geometries, polygonal geometries, regular geometries and irregular geometries. In some embodiments, each post portion may have a rounded geometry. In some embodiments, each post portion has an approximately cylindrical geometry. For example, first post portion 1314 is seen in FIG. 28 to have a rounded outer engaging surface 1330 for receiving a portion of first driven tensioning member 1220. Similarly, in the embodiment depicted in FIG. 28, second post portion 1316 has a rounded outer engaging surface 1332 for receiving a portion of driving tensioning member 1228. Also, in the embodiment depicted in FIG. 28, third post portion 1318 has a rounded outer engaging surface 1334 for receiving a portion of second driven tensioning member 1222.

In different embodiments, the geometry of one or more sidewall portions a tension balancing member could vary. Exemplary geometries that could be used include, but are not limited to: rounded geometries, polygonal geometries, regular geometries and irregular geometries. In an exemplary embodiment, first sidewall portion 1310 and second sidewall portion 1312 both have approximately circular or disc-like geometries. In other embodiments, however, first sidewall portion 1310 and second sidewall portion 1312 may have substantially different geometries.

The relative dimensions of portions of a tension balancing member could vary in different embodiments. In some embodiments, each post portion may have a substantially similar diameter. In other embodiments, different post portions could have substantially different diameters. Moreover, in at least some embodiments, the diameter of each post portion may be approximately less than one third of the diameter of the tensioning balancing member. For example, in the exemplary embodiment depicted in FIG. 28, first post portion 1314, second post portion 1316 and third post portion 1318 all have approximately similar diameters indicated as diameter D1 on third post portion 1318. First tension balancing member 1300 has a diameter D2. In this configuration, diameter D1 is substantially less than one third of diameter D2. This arrangement allows for simultaneous mounting of multiple tensioning members to first tension balancing member 1300.

It will be understood that the discussion of the features first tension balancing member 1300 may apply to second tension balancing member 1302. In other words, in some embodiments, second tension balancing member 1302 may be substantially similar to first tension balancing member 1300. For example, second tension balancing member 1302 may include corresponding sidewall portions as well as post portions to receive driving tensioning member 1228, third driven tensioning member 1224 and fourth driven tensioning member 1226.

In the configuration of first tension balancing member 1300 depicted in FIG. 28, each post portion may operate with a corresponding tensioning member to provide a pulley-like device, in which the tensioning member can translate around the post portion to accommodate changes in loads applied at first tension balancing member 1300. Throughout this detailed description, the term "pulley-like device" refers to a system that may achieve similar functionality to a conventional pulley. Specifically, a pulley-like device may facilitate the movement of a tensioning member (e.g., cable, rope, belt, lace, etc.). In contrast to some pulleys, however, a pulley-like device may not utilize a separate wheel and axle, but may rely on low frictional contact between a tensioning member and the pulley-like device to achieve similar functionality to a pulley. In some embodiments, the portion of the tensioning member in contact with the pulley-like device is rotated about a central axis of the pulley-like device.

Figure 30:
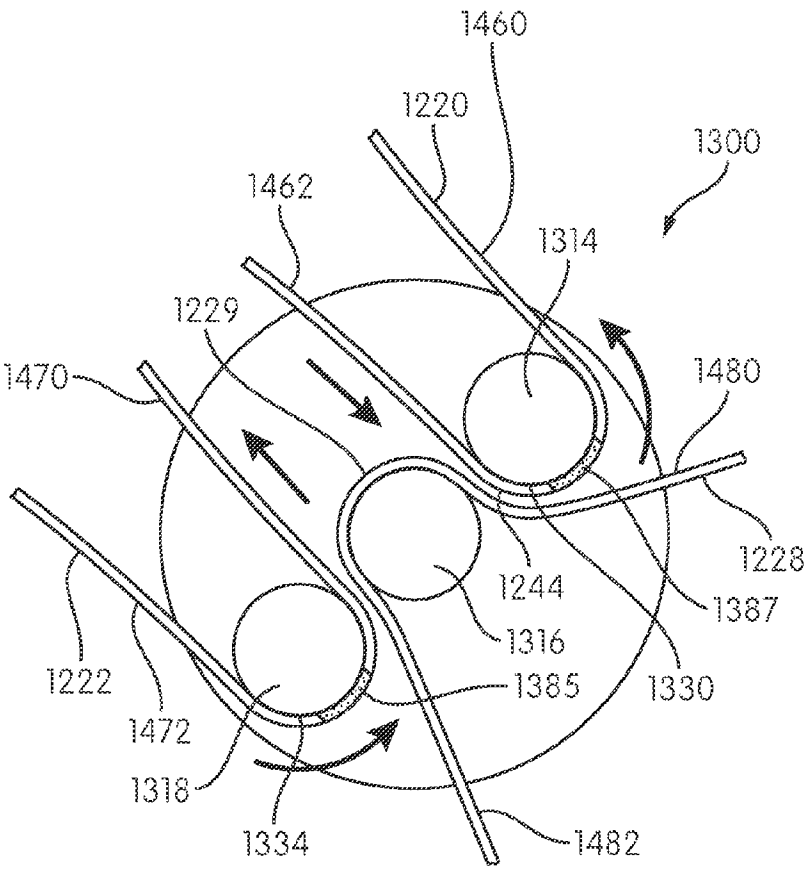
FIG. 30 is a schematic side view of an embodiment of a tension balancing member, in which two tensioning members are moved around corresponding post portions.
Figure 29:
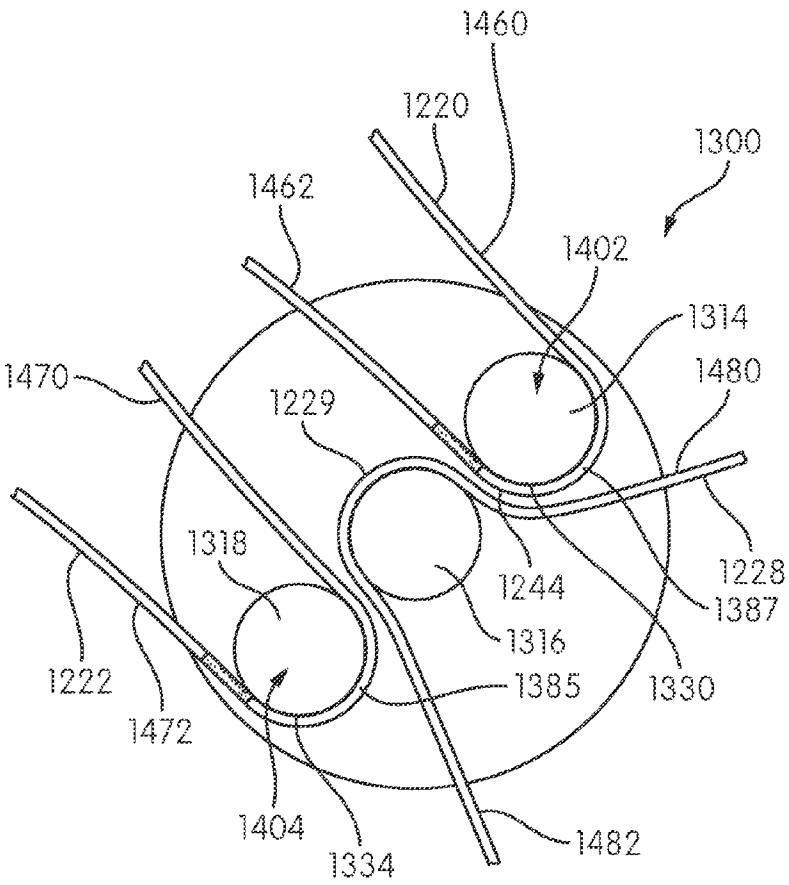
FIG. 29 is a schematic side view of an embodiment of a tension balancing member.

FIGS. 29 and 30 illustrate schematic views of an embodiment of first tension balancing member 1300, in which second sidewall portion 1312 has been removed to improve clarity of the operation of first tension balancing member 1300. Referring now to FIGS. 29 and 30, first post portion 1314 comprises a first pulley-like device 1402. Also, third post portion 1318 comprises a second pulley-like device 1404.

In operation second portion 1244 of first driven tensioning member 1220 may slide over engaging surface 1330 of first post portion 1314. If the frictional forces between second portion 1244 and engaging surface 1330 are sufficiently low enough, first post portion 1314 may function as a pulley to facilitate load balancing across portions of upper 1102 engaged by first driven tensioning member 1220. In some embodiments, the material characteristics of first driven tensioning member 1220 and first post portion 1314 may be selected to achieve sufficiently low friction between first driven tensioning member 1220 and engaging surface 1330. Thus, for example, some embodiments could utilize tensioning members comprised of smooth cords/cables and post portions comprised of low friction plastics.

In some embodiments, the configuration of second driven tensioning member 1222 with third post portion 1318 may be similar to the configuration described for first driven tensioning member 1220 and first post portion 1314. In particular, second driven tensioning member 1222 may slide over engaging surface 1334 of third post portion 1336 to facilitate load balancing across portions of upper 1102 engaged by second driven tensioning member 1222.

For purposes of illustration, a portion 1385 of first driven tensioning member 1220 and a portion 1387 of second driven tensioning member 1222 are schematically highlighted in FIGS. 29 and 30. Portion 1385 is seen to move around first post portion 1314 as first driven tensioning member moves and portion 1387 is seen to move around third post portion 1318 as second driven tensioning member 1222 moves.

The relative motion of first driven tensioning member 1220 around first pulley-like device 1402 and of second driven tensioning member 1222 around second pulley-like device 1404 may facilitate the dynamic balancing of loads across first tension balancing member 1300. For purposes of discussing this balancing, reference is made to different segments of each tensioning member. Referring to FIG. 29, for example, first driven tensioning member 1220 includes a first segment 1460 extending from pulley-like device 1402 and a second segment 1462 extending from pulley-like device 1402. First segment 1460 and second segment 1462 extend to different locations on upper 1102 and/or sole structure 1110 and are anchored in place at their ends. Similarly, second drive tensioning member 1222 includes a first segment 1470 extending from pulley-like device 1404 and a second segment 1472 extending from pulley-like device 1404. First segment 1470 and second segment 1472 extend to different locations on upper 1102 and/or sole structure 1110 and are anchored in place at their ends. Still further, driving tensioning member 1298 includes a first segment 1480 extending from second post portion 1316 and a second segment 1482 extending from second post portion 1316.

As first tension balancing member 1300 is pulled by driving tensioning member 1298 (due to tensions applied by first segment 1480 and second segment 1482), the loads across the different segments of first driven tensioning member 1220 and second driven tensioning member 1222 may vary. Because each driven tensioning member can translate about a corresponding pulley-like device, the loads across the different segments can be dynamically balanced in response to the increased tension applied by driving tensioning member 1298. Specifically, the loads across first segment 1460 and second segment 1462 of first driven tensioning member 1220 as well as the loads across first segment 1470 and second segment 1472 of second driven tensioning member 1220 may be simultaneously balanced with the loads applied by first segment 1480 and second segment 1482 of driving tensioning member 1298. This dynamic balancing may improve comfort and fit of the upper when fastened around a foot.

In some embodiments, second post portion 1316 may also operate as a pulley-like device. However, in some other embodiments, second post portion 1316 may not operate as a pulley. In certain embodiments, as shown in FIGS. 29 and 30, a portion 1229 of driving tensioning member 1228 may be permanently attached to second post portion 1316. Such a configuration may enhance the transfer of tension between driving tensioning member 1228 and the driven tensioning members by reducing slip between driving tensioning member 1228 and first tension balancing member 1300.

Although the description above is directed to the operation of first tension balancing member 1300, it will be understood that in at least some embodiments, the operation of second tension balancing member 1302 may be substantially similar to the operation of first tension balancing member 1300. In particular, second tension balancing member 1302 may operate to dynamically balance the loads applied by third driven tensioning member 1224, fourth driven tensioning member 1226 and driving tensioning member 1228.

Referring again to FIGS. 21-22, in some embodiments, article 1100 may be configured with provisions to facilitate the attachment and/or control of tensioning members in an article. In some embodiments, article 1100 may include a first fixed guide member 1290 and a second fixed guide member 1292, which may act to help guide the path of driving tensioning member 1228. In some embodiments, first fixed guide member 1290 may be mounted to a portion of upper 1102 that is near sole structure 1110. A similar location may be used for second fixed guide member 1292 on an opposing side of article 1100. In some cases, first fixed guide member 1290 and second fixed guide member 1292 may be positioned to control the direction of pulling applied by driving tensioning member 1228 to plurality of driven tensioning members 1210.

Referring now to FIG. 26, some embodiments may include a heel guide member 1295. Heel guide member 1295 may be disposed on heel portion 1014 of upper 1102. In some embodiments, heel guide member 1295 may provide a channel 1296 to receive driving tensioning member 1228 at heel portion 1014. As specifically shown in FIG. 26, in some embodiments, driving tensioning member 1228 travels through heel guide member 1295 from a lateral side 1016 to a medial side 1018 of upper 1102.

Some embodiments may incorporate guide members on upper 1102 that constrain the movement of one or more driven tensioning members. As shown in the embodiments depicted in FIGS. 21-23, upper 1102 includes a plurality of guide members 1298. In the exemplary embodiment, plurality of guide members 1298 are mostly disposed within, or near, instep portion 1160. In some embodiments, plurality of guide members 1298 are used to constrain the movement of first driven tensioning member 1220, second driven tensioning member 1222, third driven tensioning member 1224 and fourth driven tensioning member 1226. In certain embodiments, as depicted in FIGS. 21-23, plurality of guide members 1298 are positioned to maintain a grid-like arrangement for plurality of tensioning members 1210 on upper 1102.

Plurality of guide members 1298 are depicted in FIGS. 21-23 as stitches that form an opening through which driven tensioning members may translate. However, other embodiments may utilize any other kinds of guide members, including various kinds of fasteners that might constrain the arrangement of tensioning members on upper 1102, while allowing the tensioning members to translate in a direction oriented along their respective lengths.

As seen in FIGS. 21-25, the various tensioning members may be arranged on article 1100 to provide a means for closing instep portion 1160 around a foot. To achieve this, each driven tensioning member extends from one side of upper 1102, across instep portion 1160, and onto an opposing side of upper 1102. For example, both first portion 1242 and third portion 1246 of first driven tensioning member 1220 extend from first tension balancing member 1300 on medial side 1018, over instep portion 1160 and onto lateral side 1016 of upper 1102 (see FIGS. 24-25). Portions of second driven tensioning member 1222 may likewise extend from first tension balancing member 1300 on medial side 1018, over instep portion 1160 and onto lateral side 1016 of upper 1102. Similarly, portions of third driven tensioning member 1224 extend from second tension balancing member 1302 on lateral side 1016, over instep portion 1160 and onto medial side 1018 of upper 1102. Also, portions of fourth driven tensioning member 1226 extend from second tension balancing member 1302 on lateral side 1016, over instep portion 10160 and onto medial side 1018 of upper 1102.

In certain embodiments, depicted in FIGS. 21-23, first driven tensioning member 1220, second driven tensioning member 1222, third driven tensioning member 1224 and fourth driven tensioning member 1226 are arranged in a grid-like pattern 1299 (see FIG. 23) over upper 1102, including at instep portion 1160. Although some embodiments may incorporate a regularly spaced grid, the embodiments shown in FIGS. 21-23 depict a grid with irregular spacing. This grid-like configuration provides a mesh of driven tensioning members that wrap around upper 1102, especially at instep portion 1160. In some embodiments, the grid-like pattern 1299 may be arranged so that pressure is applied approximately evenly over instep portion 1160 during tightening. In other embodiments, however, the grid-like pattern 1299 may be arranged so that pressure is higher in some regions and lower in others during tightening.

Figure 27:
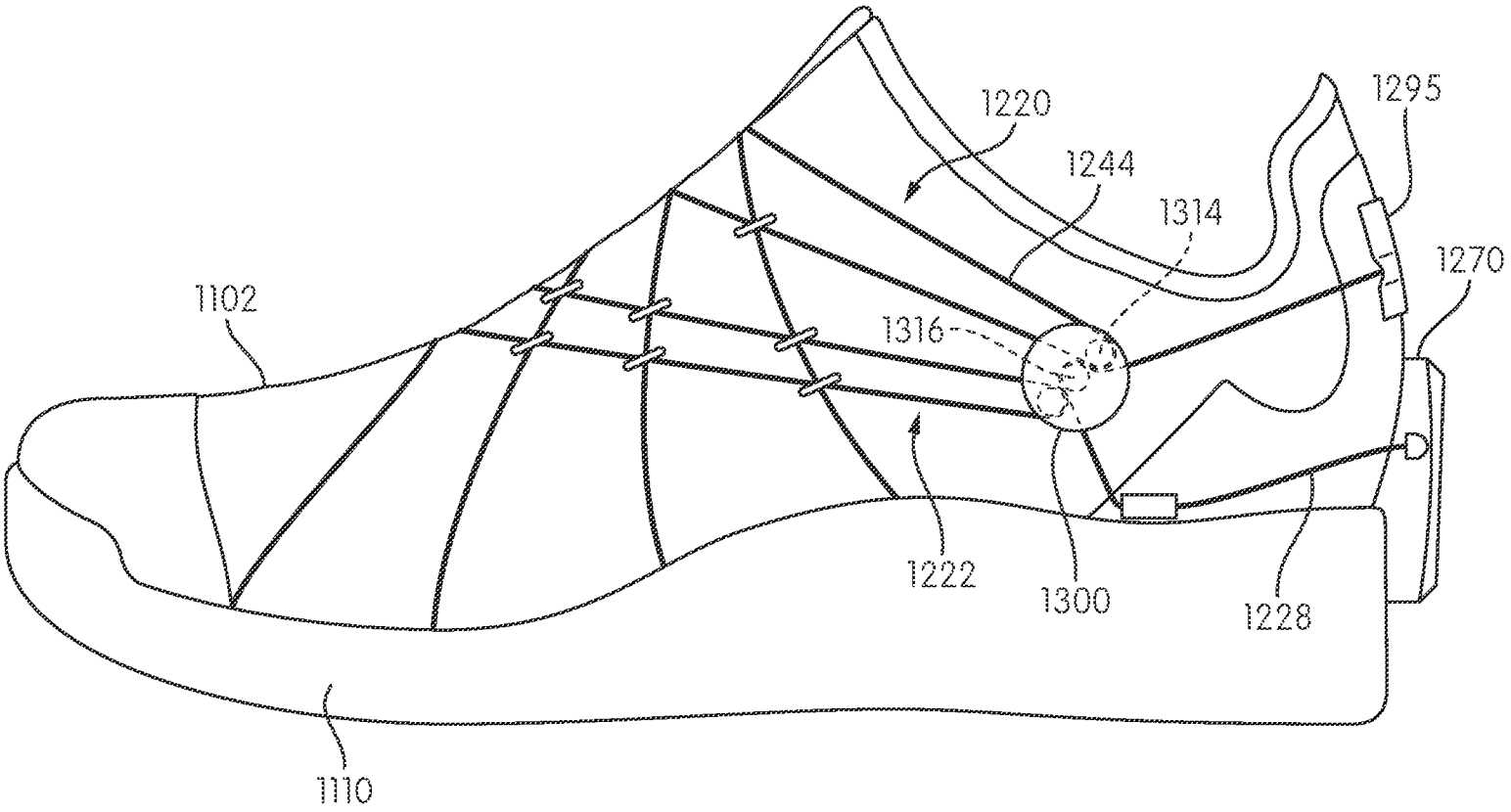
FIG. 27 is a side view of an embodiment of an article of footwear including a tensioning system.

As clearly seen in FIGS. 21-22, and in FIG. 27, each driven tensioning member is looped around a corresponding post portion of a tension balancing member. For example, second portion 1244 of first tension balancing member 1220 is looped around first post portion 1314 (see FIG. 27) of first tension balancing member 1300. Likewise, the remaining tension balancing members are each looped around a corresponding post portion in a similar manner.

Driving tensioning member 1228 may extend in a loop between tensioning device 1270 and the tension balancing members. Specifically, as best seen in FIGS. 24-27, driving tensioning member 1228 extends from tensioning device 1270 to first fixed guide member 1290 and up to first tension balancing member 1300. At first tension balancing member 1300, a portion of driving tensioning member 1228 wraps around second post portion 1316 and then extends from first tension balancing member 1300 to heel guide member 1295. At heel guide member 1295, driving tensioning member 1228 wraps around heel portion 1014 of upper 1102, and then extends on lateral side 1016 of upper 1102 to second tension balancing member 1302. At second tension balancing member 1302, a portion of driving tensioning member 1228 wraps around a post portion 1360 and then extends from second tension balancing member 1302 to second fixed guide member 1292. Finally, from second fixed guide member 1292, driving tensioning member 1228 extends back to tensioning device 1270.

The configuration discussed here and shown in FIGS. 21-26 provides a tensioning system in which loads applied to different components (e.g., driven tensioning members, driving tensioning members, etc.) can be balanced across the entire system. This load balancing is achieved by facilitating the translation of each driven tensioning member around a corresponding pulley-like device of a tension balancing member. Load balancing may be further facilitated since loads can be transferred directly between tension balancing members on opposing sides of an article via a driving tensioning member which connects the tension balancing members directly. The resulting system is highly dynamic and therefore capable of accommodating various different load configurations across upper 1102, such that the resulting pressure applied across upper 1102 improves fit and comfort.

Some embodiments may be configured to accommodate a rotational mode for tension balancing members that further acts to facilitate load balancing. In particular, some embodiments can accommodate rotation of a tension balancing member about its own central axis, in addition to the rotation of driven tensioning members about their respective pulley-like devices.

Figure 31:
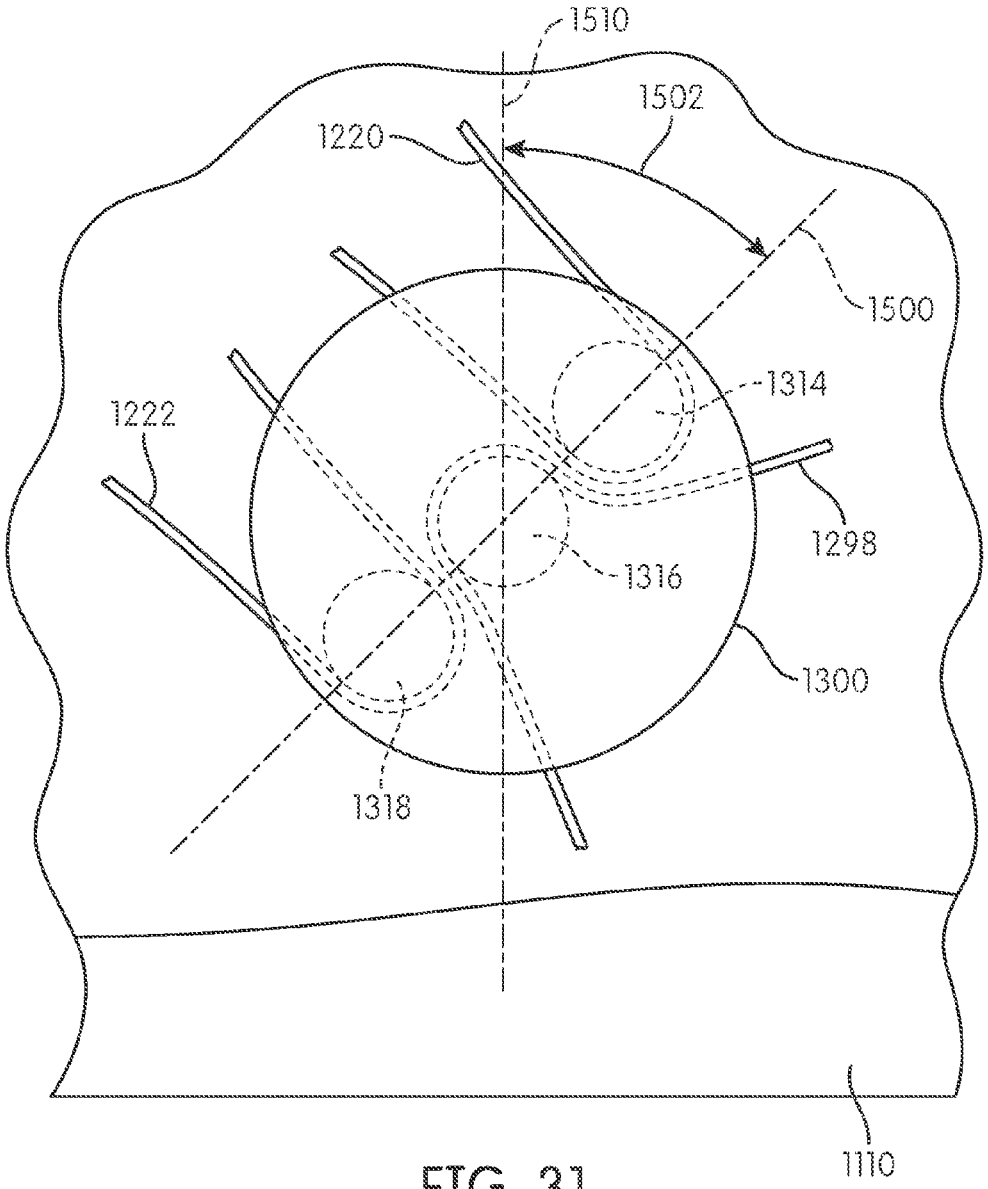
FIG. 31 is a schematic side view of an embodiment of a tension balancing member in a first angular position.
Figure 32:
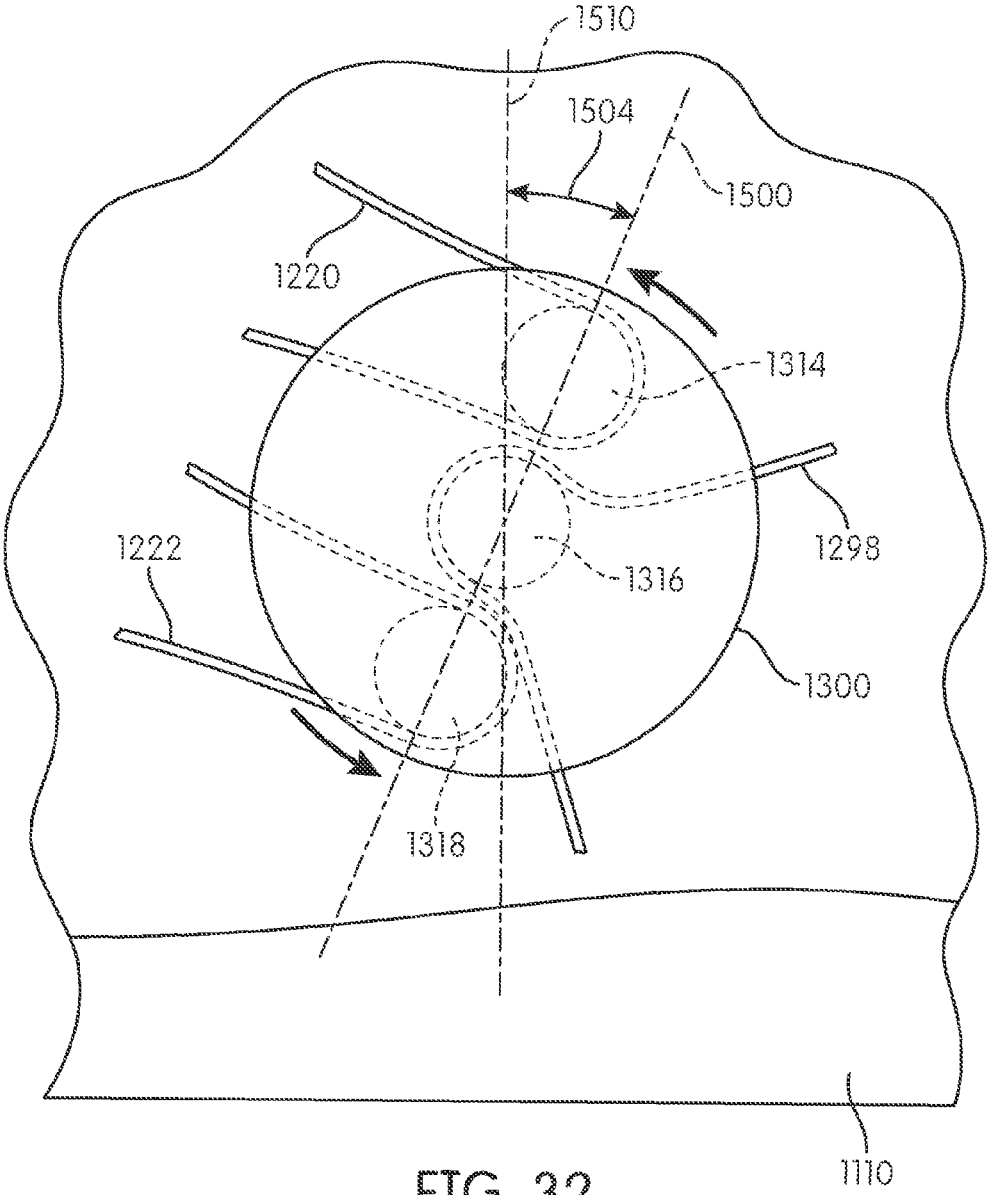
FIG. 32 is a schematic side view of an embodiment of a tension balancing member in a second angular position.

FIGS. 31 and 32 depict schematic views of first tension balancing member 1300 undergoing a rotational mode in order to further facilitate load balancing. Although this discussion describes a possible rotational mode for first tension balancing member 1300, it will be understood that a similar rotational mode may also be achieved by second tension balancing member 1302 in some embodiments.

Referring to FIG. 31, in a first loading configuration, first tension balancing member 1300 is oriented such that an axis 1500 extending through first post portion 1314, second post portion 1316 and third post portion 1318 has a first angular position 1502. For purposes of convenience, angular position 1502 is measured between axis 1500 and a vertical axis 1510, which is an axis extending approximately in a perpendicular direction to sole structure 1110 of article 1100. Referring next to FIG. 32, a second loading configuration results in a rotation of first tension balancing member 1300 in order to achieve load balancing. Specifically, first tension balancing member 1300 has rotated about a central axis 1520 so that axis 1500 now has an angular position 1504. Thus, load balancing is achieved in this case by rotation of first tension balancing member 1300.

Referring to FIGS. 31-32, in at least some embodiments, first post portion 1314, second post portion 1316 and third post portion 1318 may be approximately co-linear. In other words, first post portion 1314, second post portion 1316 and third post portion 1318 may lie on a common line, which is indicated in FIGS. 31-32 as axis 1500. Such a configuration may enhance load balancing. In other embodiments, however, at least one post portion may lie off of a line joining the other two post portions. The approximate locations of each post portion within first tension balancing member 1300 can be selected to achieve desired load balancing characteristics according to factors including the lengths of the driven tensioning members and the location of first tension balancing member 1300 on upper 1102.

Figure 33:
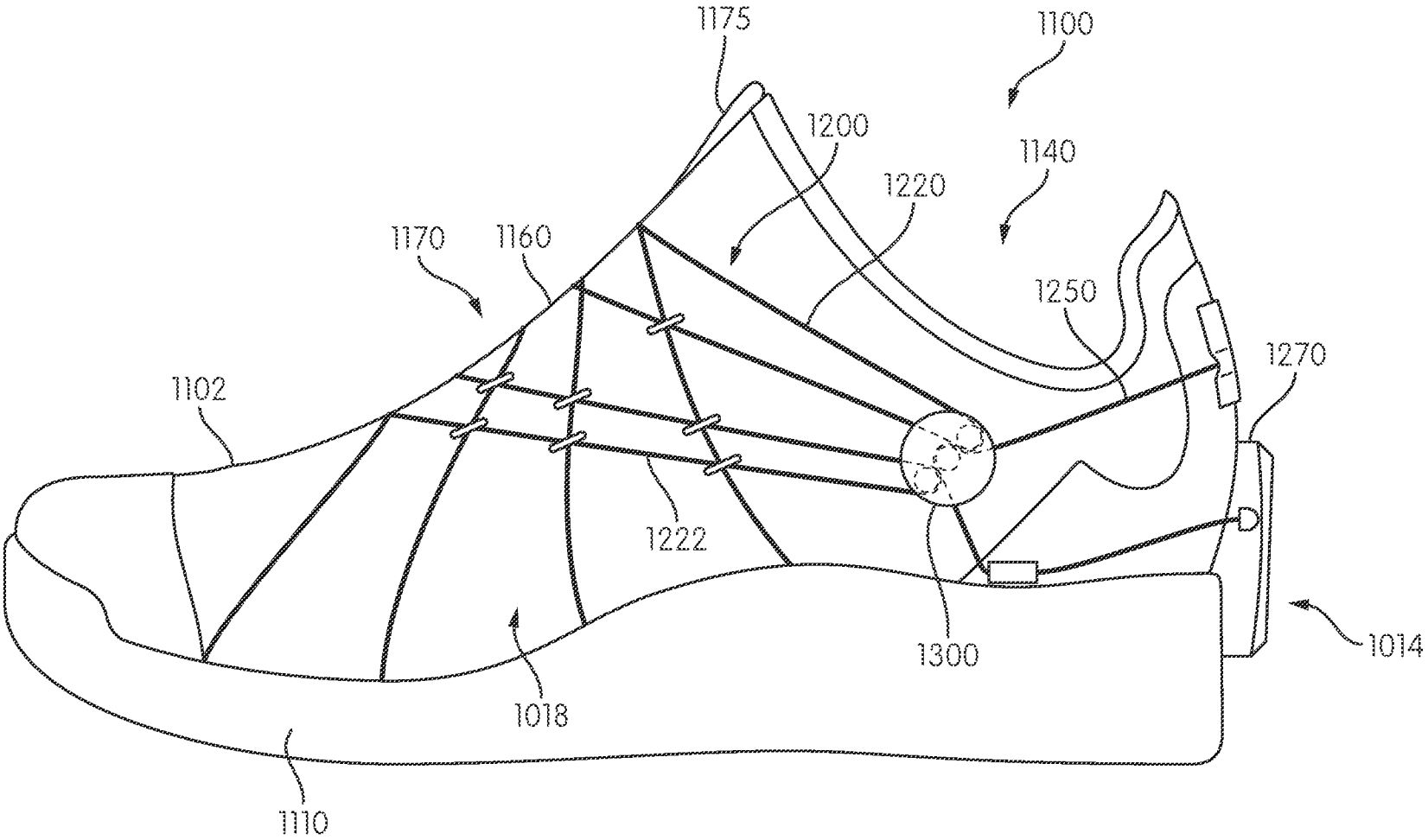
FIG. 33 is a side view of an embodiment of an article of footwear with a tensioning system in a loosened configuration.
Figure 34:
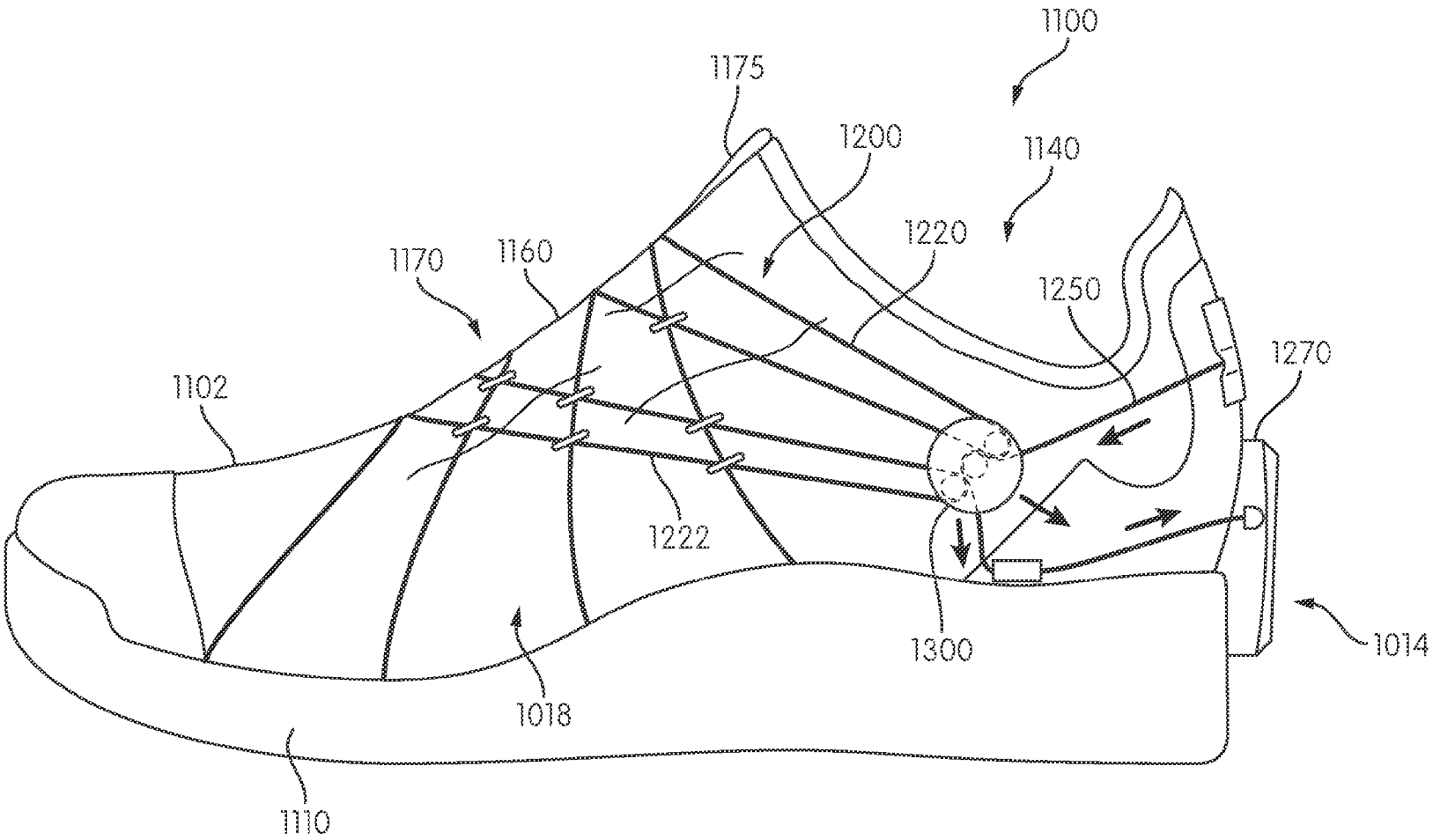
FIG. 34 is a side view of the article of footwear of FIG. 31, in which the tensioning system is actively tightened.
Figure 35:
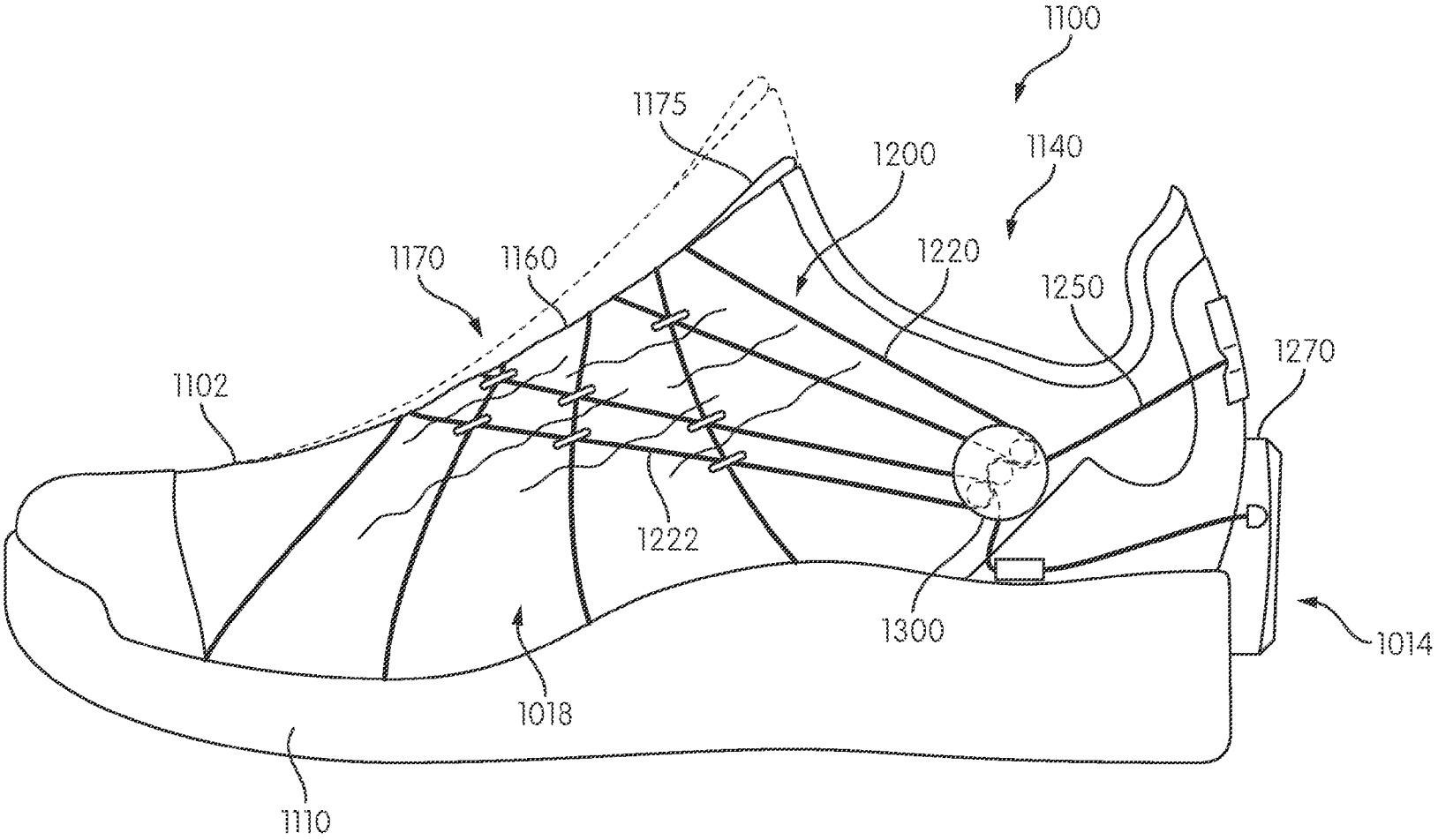
FIG. 35 is a side view of the article of footwear of FIG. 33, in a tightened configuration.

FIGS. 33-35 illustrate a sequence of fastening upper 1102 using tensioning system 1200, according to one embodiment. For purposes of clarity, FIGS. 33-35 depict the operation of tensioning system 1200 on medial side 1018 of upper 1102, though it will be understood that components on lateral side 1016 (e.g., second tension balancing member 1302) may operate in a similar manner simultaneously with the components shown on medial side 1018.

Initially, as seen in FIG. 33, upper 1102 may be fully open. In this case, instep portion 1160 is in an expanded configuration that allows for easy insertion of a foot. In some cases, instep portion 1160 could be further expanded, and opening 1140 further widened, by pulling on tab portion 1175.

Tightening of upper 1102 may be initiated in any manner. In some embodiments, a remote device may be used to signal tensioning device 1270 to begin tightening upper 1102. An exemplary remote device has been described above and shown in FIGS. 9-12, however other embodiments could utilize any other kinds of remote devices. Moreover, it will be understood that the kinds of controls discussed for the remote device of FIGS. 9-12 may be utilized to control tightening and/or loosening of upper 1102 in a similar manner. In still other embodiments, one or more control buttons could be incorporated directly into article 1100, such as on an outer casing of tensioning device 1270 or on the sidewalls of sole structure 1110. In such an embodiment, a user may simply touch the one or more control buttons to initiate tightening.

As seen in FIG. 34, with tensioning device 1270 activated, both first portion 1250 and second portion 1252 (see FIG. 26) of driving tensioning member 1228 may be further retracted into tensioning device 1270. This retraction results in increased tension being applied to first driven tensioning member 1220 and second driven tensioning member 1222 by their connection to driving tensioning member 1228 via first tension balancing member 1300. In a similar manner, third driven tensioning member 1224 and fourth driven tensioning member 1226 (see FIG. 22) may be tensioned by their connection to driving tensioning member 1230 via second tension balancing member 1302. As first set of driven tensioning members 1212 and second set of driven tensioning members 1214 are pulled by driving tensioning member 1228, instep portion 1160 is contracted in order to fasten upper 1102 around the foot. For example, in the fully tightened configuration shown in FIG. 35, opening 1140 may be constricted in size and instep portion 1160 may be tightened against the top of a foot, when article 1100 is worn.

In certain embodiments, shown in FIGS. 33-35, first tension balancing member 1300 may generally travel on a path moving downwardly (i.e., towards sole structure 1110) and rearwardly (i.e., towards heel portion 1014). This motion of first tension balancing member 1300 away from the fixed ends of first driven tensioning member 1220 and second driven tensioning member 1222 on an opposing side of upper 1102 results in first driven tensioning member 1220 and second driven tensioning member 1222 being pulled against instep portion 1160 in order to fasten instep portion 1160 against a foot.

The change in tension that occurs in FIGS. 33-35 may result in a corresponding decrease in volume for intermediate covering portion 1170. Specifically, intermediate covering portion 1170 may be associated with a first volume in the loosened configuration for article 1100 shown in FIG. 33 and intermediate covering portion 1170 may be associated with a second volume in the tightened configuration for article 1100 shown in FIG. 35. In the exemplary embodiment, the second volume may be substantially less than the first volume, thereby creating a smaller interior cavity within upper 1102 in order to keep upper 1102 fastened around a foot.

Figure 36:
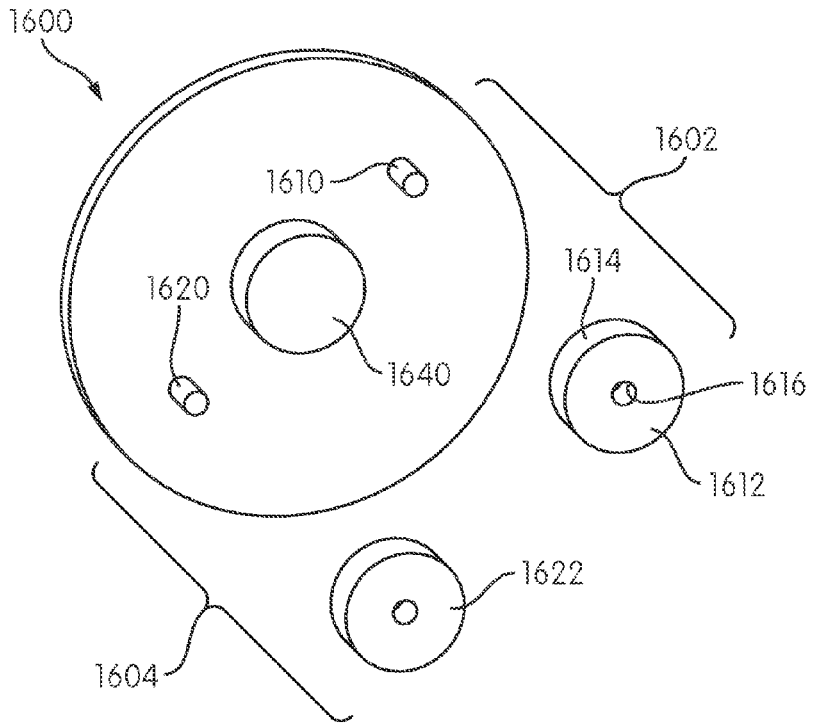
FIG. 36 is a schematic exploded isometric view of a tension balancing member including two pulley systems.
Figure 37:
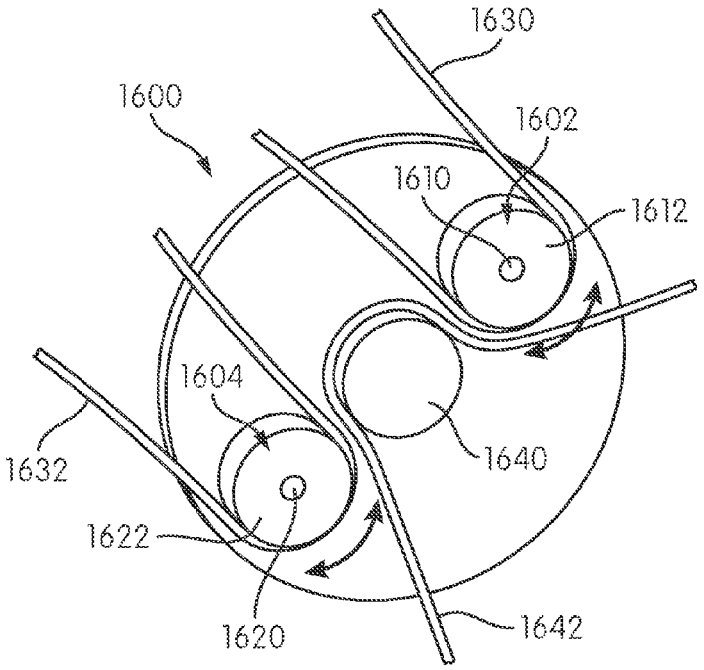
FIG. 37 is a schematic isometric view of a tension balancing member including two pulley systems.

The embodiments described above and depicted in FIGS. 21-33 include tension balancing members with pulley-like devices. It will be understood that in some other embodiments, a tension balancing member could incorporate one or more pulleys that each comprise a wheel member and an axle member. For example, FIGS. 36 and 37 illustrate schematic isometric views of an alternative embodiment for a tension balancing member 1600, which includes a first pulley device 1602 and a second pulley device 1604. In this exemplary embodiment, first pulley device 1602 includes an axle member 1610 and a wheel member 1612. Wheel member 1612 may include a receiving surface 1614 for engaging a tensioning member 1630, and may include a central opening 1616 for engaging axle member 1610. Second pulley device 1604 may include a similar axle member 1620 and wheel member 1622 for facilitating the motion of tensioning member 1632. This pulley configuration for a tension balancing member could be utilized in embodiments where low amounts of friction between a tensioning member and a post member are difficult to achieve. Although the embodiment shown in FIGS. 34-25 depicts a central post portion 1640 for receiving driving tensioning member 1642, other embodiments could incorporate a pulley with a wheel and an axle to receive driving tensioning member 1642.

It will be understood that embodiments can include any number of tensioning members, including both driven tensioning members and driving tensioning members. Although the exemplary embodiment illustrates a configuration having four driven tensioning members, other embodiments could utilize a single driven tensioning member. Still other embodiments could use two driven tensioning members. Other embodiments could utilize, three, four or more driven tensioning members.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear, comprising:

an upper having a toe covering portion and an entry hole for receiving a foot;

an intermediate covering portion disposed between the toe covering portion and the entry hole, wherein the intermediate covering portion is adapted to be closed around an instep of the foot and wherein a volume of the intermediate covering portion is variable;

a first tension balancing member comprising a first sidewall joined to a second sidewall that form a substantially enclosed space, the first sidewall being disposed between the upper and the second sidewall, the enclosed space including a first post portion, a second post portion and a third post portion;

the first post portion, the second post portion, and the third post portion each being cylindrical and extending from a surface of the first sidewall to a surface of the second sidewall;

a driving tensioning member having a first portion that is permanently attached to the second post portion of the first tension balancing member and the driving tensioning member having a second portion that engages with a tensioning device;

a first driven tensioning member disposed around the first post portion, the first driven tensioning member having a first and second end, wherein the first and second ends of the first driven tensioning member are attached to the upper;

a second driven tensioning member disposed around the third post portion, the second driven tensioning member having a first and second end, wherein the first and second ends of the second driven tensioning member are attached to the upper;

wherein the first driven tensioning member can translate around the first post portion of the first tension balancing member and wherein the second driven tensioning member can translate around the third post portion of the first tension balancing member; and wherein increasing the tension of the driving tensioning member results in increased tension in the first driven tensioning member and the second driven tensioning member, which substantially decreases the volume of the intermediate covering portion.

2. The article of footwear according to claim 1, wherein the first sidewall and the second sidewall are joined by the first post portion, wherein the first sidewall and the second sidewall are joined by the second post portion and wherein the first sidewall and the second sidewall are joined by the third post portion.

3. The article of footwear according to claim 1, wherein the first tension balancing member comprises a disc shape, the disc shape including a central axis and wherein the first tension balancing member can rotate about the central axis in response to tensioning forces applied by the first driven tensioning member, the second driven tensioning member and the driving tensioning member.

4. The article of footwear according to claim 1, wherein the first driven tensioning member is a cable, wherein the second driven tensioning member is a cable and wherein the driving tensioning member is a cable.

5. The article of footwear according to claim 1, wherein the first end of the first driven tensioning member is attached to a first side of the article of footwear, wherein the second end of the first driven tensioning member is attached to the first side of the article of footwear and wherein the first tension balancing member is associated with a second side of the article of footwear, the second side being opposite the first side.

6. The article of footwear according to claim 5, wherein the article of footwear further comprises a second tension balancing member that is associated with the first side of the article of footwear.

7. An article of footwear, comprising:

an upper having an instep portion;

a first tension balancing member and a second tension balancing member, the first tension balancing member having a central axis about which the first tension balancing member rotates with respect to the upper;

a driving tensioning member including a first portion that is permanently attached to a first post portion on an interior of the first tension balancing member such that movement of the driving tensioning member causes rotation of the first tension balancing member, the driving tensioning member including a second portion that is permanently attached to a second post portion on an interior of the second tension balancing member such that movement of the driving tensioning member causes rotation of the second tension balancing member, and the driving tensioning member including a third portion extending between the first portion and the second portion, the third portion being associated with a tensioning device, the tensioning device being attached to the article of footwear;

a first driven tensioning member extending from a medial side to a lateral side of the instep portion, the first driven tensioning member having a first and second end, wherein the first and second ends of the first driven tensioning member are permanently attached to the article of footwear;

a second driven tensioning member extending from the medial side to the lateral side of the instep portion, the second driven tensioning member having a first and second end, wherein the first and second ends of the second driven tensioning member are permanently attached to the article of footwear;

wherein the first tension balancing member rotates about the central axis in response to forces applied to the first tension balancing member by the driving tensioning member, the first driven tensioning member and the second driven tensioning member; and wherein increasing tension in the driving tensioning member using the tensioning device increases the tension in the first driven tensioning member and the second driven tensioning member, thereby fastening the upper.

8. The article of footwear according to claim 7, wherein: the first driven tensioning member is engaged with the first post portion of the first tension balancing member, wherein the first driven tensioning member can move around the first post portion; wherein the second driven tensioning member is engaged with the second post portion of the first tension balancing member, wherein the second driven tensioning member can move around the second post portion, and wherein the first post portion and the second post portion each comprise a cylindrical geometry.

9. The article of footwear according to claim 7, wherein the article of footwear further includes a guide member that guides the driving tensioning member in a path from the first tension balancing member to the tensioning device.

10. The article of footwear according to claim 9, wherein the guide member is disposed rearwardly of the first tension balancing member.

11. The article of footwear according to claim 7, wherein the tensioning device is disposed rearwardly of both the first tension balancing member and the second tension balancing member.

12. The article of footwear according to claim 7, wherein the first tension balancing member comprises a first sidewall joined to a second sidewall, each of the first sidewall and the second sidewall having a disc shape.

13. An article of footwear, comprising: an upper having an instep portion; a tension balancing member including a first pulley device and a second pulley device; a driving tensioning member having a first portion that is permanently attached to the tension balancing member and a second portion that engages with a tensioning device, the tensioning device being attached to the article of footwear; a first driven tensioning member disposed around the first pulley device, the first driven tensioning member having a first and second end, wherein the first and second ends of the first driven tensioning member are attached to the upper; a second driven tensioning member disposed around the second pulley device, the second driven tensioning member having a first and second end, wherein the first and second ends of the second driven tensioning member are attached to the upper; wherein the first driven tensioning member extends from a first end that is attached to a medial side of a lower periphery of the upper to the first pulley device disposed on a lateral side of the upper, loops around the first pulley device, and extends from the first pulley device to a second end that is attached to the medial side of the lower periphery of the upper; wherein the first driven tensioning member can move around the first pulley device and wherein the second driven tensioning member can move around the second pulley device; and wherein increasing tension in the driving tensioning member using the tensioning device decreases a distance between the tension balancing member and the tensioning device and increases the tension in the first driven tensioning member and the second driven tensioning member, thereby fastening the upper.

14. The article of footwear according to claim 13, wherein the first pulley device and the second pulley device are positioned on opposing sides within an interior of the tension balancing member.

15. The article of footwear according to claim 14, wherein the driving tensioning member is permanently attached to a post portion of the tension balancing member, and wherein the post portion is disposed between the first pulley device and the second pulley device.

16. The article of footwear according to claim 13, wherein: the tension balancing member is a first tension balancing member and wherein the article of footwear includes a second tension balancing member; wherein the article of footwear includes a third driven tensioning member engaged with the second tension balancing member, the third driven tensioning member having a first and second end, wherein the first and second ends of the third driven tensioning member are fixed to the upper; wherein the article of footwear includes a fourth driven tensioning member engaged with the second tension balancing member, the fourth driven tensioning member having a first and second end, wherein the first and second ends of the fourth driven tensioning member are fixed to the upper; wherein the first tension balancing member is disposed on the lateral side and wherein the second tension balancing member is disposed on the medial side.

17. The article of footwear according to claim 16, wherein the second driven tensioning member extends from the first end of the second driven tensioning member that is attached to the medial side of the lower periphery of the upper to the second pulley device that is disposed on the lateral side of the upper, loops around the second pulley device, and extends from the second pulley device to the second end of the second driven tensioning member that is attached to the medial side of the lower periphery of the upper.

18. The article of footwear according to claim 17, wherein the third driven tensioning member extends from the first end of the third driven tensioning member that is attached to the lateral side of the lower periphery of the upper to a third pulley device of the second tension balancing member that is disposed on the medial side of the upper, loops around the third pulley device, and extends from the third pulley device to the second end of the third driven tensioning member that is attached to the lateral side of the lower periphery of the upper, and wherein the fourth driven tensioning member extends from the first end of the fourth driven tensioning member that is attached to the lateral side of the lower periphery of the upper to a fourth pulley device of the second tension balancing member that is disposed on the medial side of the upper, loops around the fourth pulley device, and extends from the fourth pulley device to the second end of the fourth driven tensioning member that is attached to the lateral side of the lower periphery of the upper.

19. The article of footwear according to claim 18, wherein the first driven tensioning member and the third driven tensioning member criss-cross, and wherein the second driven tensioning member and the fourth driven tensioning member criss-cross, such that the driven tensioning members form a grid on the instep portion of the upper.

* * * * *